US010801784B2

(12) United States Patent
Nagano et al.

(10) Patent No.: US 10,801,784 B2
(45) Date of Patent: Oct. 13, 2020

(54) HEAT EXCHANGER WITH AIR FLOW PASSAGE FOR EXCHANGING HEAT

(71) Applicant: DAIKIN INDUSTRIES, LTD., Osaka (JP)

(72) Inventors: Tomohiro Nagano, Osaka (JP); Yoshiyuki Matsumoto, Osaka (JP); Shun Yoshioka, Osaka (JP); Satoshi Inoue, Osaka (JP); Toshimitsu Kamada, Osaka (JP); Shouta Agou, Osaka (JP); Chiho Kitayama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/093,464

(22) PCT Filed: Apr. 10, 2017

(86) PCT No.: PCT/JP2017/014729
§ 371 (c)(1),
(2) Date: Oct. 12, 2018

(87) PCT Pub. No.: WO2017/179553
PCT Pub. Date: Oct. 19, 2017

(65) Prior Publication Data

US 2019/0120557 A1 Apr. 25, 2019

(30) Foreign Application Priority Data

Apr. 13, 2016 (JP) ..... 2016-080373

(51) Int. Cl.
*F28D 1/053* (2006.01)
*F28F 1/32* (2006.01)
*F28D 21/00* (2006.01)

(52) U.S. Cl.
CPC ..... *F28D 1/05391* (2013.01); *F28D 1/053* (2013.01); *F28D 1/05366* (2013.01);
(Continued)

(58) Field of Classification Search
CPC ..... F28F 1/32; F28F 1/325; F28D 1/05391; F28D 1/053; F28D 1/05366
(Continued)

(56) References Cited

U.S. PATENT DOCUMENTS 4,907,646 A * 3/1990 Aoyagi ..... F28F 1/325 165/151
5,109,919 A * 5/1992 Sakuma ..... F28F 1/325 165/151
(Continued)

FOREIGN PATENT DOCUMENTS

CN 103299149 A 9/2013
DE 102012002234 A1 8/2013
(Continued)

OTHER PUBLICATIONS

Extended European Search Report issued in corresponding European Patent Application 17782366.3 dated Mar. 7, 2019 (6 pages).
(Continued)

*Primary Examiner* — Paul Alvare
(74) *Attorney, Agent, or Firm* — Osha Liang LLP

(57) ABSTRACT

A heat exchanger includes: multiple flat tubes that extend in a second direction intersecting a first direction which is an air flow direction and that are disposed at intervals in a third direction that intersects the first direction and the second direction; and multiple plate-like heat transfer fins that extend along the third direction and that are disposed at intervals along the second direction. The heat exchanger causes refrigerant in the flat tubes to exchange heat with the air flow that passes through heat exchange spaces formed by
(Continued)

adjacent flat tubes and adjacent heat transfer fins when viewed from the first direction. The heat transfer fins each have a heat transfer fin front side surface that is one main surface, a heat transfer fin back side surface that is the other main surface.

9 Claims, 21 Drawing Sheets

(52) U.S. Cl.
CPC ..... *F28F 1/32* (2013.01); *F28F 1/325* (2013.01); *F28D 2021/0068* (2013.01); *F28F 2215/02* (2013.01); *F28F 2215/12* (2013.01)

(58) Field of Classification Search
USPC ..... 165/151
See application file for complete search history.

(56) References Cited

U.S. PATENT DOCUMENTS

| | | | | |
|---|---|---|---|---|
| 6,786,274 | B2 * | 9/2004 | Bemisderfer | F28D 1/0477 165/151 |
| 2013/0299141 | A1 * | 11/2013 | Jindou | F28D 1/05383 165/151 |
| 2013/0299152 | A1 * | 11/2013 | Ohtani | F28D 1/05383 165/181 |

FOREIGN PATENT DOCUMENTS

| | | | |
|---|---|---|---|
| JP | 2003-90691 | A | 3/2003 |
| JP | 4845943 | B2 | 12/2011 |
| JP | 2012-233680 | A | 11/2012 |
| JP | 2015-31484 | A | 2/2015 |
| JP | 2015-132468 | A | 7/2015 |
| JP | 2016084976 | A | 5/2016 |

OTHER PUBLICATIONS

Notification of Transmittal of Translation of the International Preliminary Report on Patentability for International Application No. PCT/JP2017/014729 dated Oct. 25, 2018 (1 page).
International Preliminary Report on Patentability issued in corresponding International Application No. PCT/JP2017/014729 dated Oct. 16, 2018 (5 pages).
International Search Report issued in corresponding International Application No. PCT/JP2017/014729 dated Jul. 4, 2017, with translation (5 pages).
Written Opinion of the International Searching Authority issued in corresponding International Application No. PCT/JP2017/014729 dated Jul. 4, 2017 (3 pages).
Office Action Issued in corresponding Japanese Patent Application No. 2017-077594 dated Jun. 22, 2017, with translation (6 pages).
Chinese Office Action issued in corresponding application No. CN201780023157.8 dated Apr. 1, 2019 (11 pages).

* cited by examiner

HEAT EXCHANGER WITH AIR FLOW PASSAGE FOR EXCHANGING HEAT

TECHNICAL FIELD

The present invention relates to a heat exchanger.

BACKGROUND

Conventionally, there has been known a heat exchanger including multiple flat tubes and multiple heat transfer fins extending to intersect the flat tubes and causes refrigerant in the flat tubes to exchange heat with the air flow passing through heat exchange spaces formed by adjacent flat tubes and adjacent heat transfer fins. In such a heat exchanger, there is a heat exchanger including the heat transfer fin provided with a protrusion protruding to intersect a direction of an air flow (air flow direction) in order to improve a heat transfer coefficient.

For example, Patent Document 1 (U.S. Pat. No. 4,845,943) discloses a heat exchanger of an air conditioning indoor unit including heat transfer fins having a plurality of protrusions that are formed by cutting and raising a portion thereof. In Patent Document 1, the shape of the protrusions is cut and raised differently between the windward side protrusions located on the windward side and the leeward side protrusions located on the leeward side (specifically, the attack angle with respect to the air flow and the cut-and-raised angle), and it is thereby attempted to minimize the generation of a dead water region and reduce the ventilation resistance of the protrusions.

The inventor of the present application has discovered through extensive study that as in Patent Document 1, in the heat exchanger where a large gap is formed between each protrusion and a main surface of the flat tubes in the heat exchange space when viewed from the air flow direction, regarding the air flow passing through the heat exchange space, a drift phenomenon, in which the flow velocity of the air passing through such a gap becomes significantly higher as compared with the flow velocity of the air passing through the periphery of the protrusions, easily occurs as to the air flow passing through the heat exchange space. When such a drift phenomenon occurs, it is difficult to satisfactorily perform heat exchange between the refrigerant in the flat tubes and the air flow, leading to a degradation in the performance of the heat exchanger.

SUMMARY

A heat exchanger according to one or more embodiments is capable of restraining performance degradation.

A heat exchanger according to one or more embodiments of the present invention includes multiple flat tubes and multiple heat transfer fins and configured and arranged to cause refrigerant in the flat tubes to exchange heat with an air flow passing through a heat exchange space. The flat tubes extend in a second direction intersecting a first direction. The first direction is a flow direction of the air flow. The multiple flat tubes are arranged at intervals in a third direction. The third direction is a direction intersecting the first direction and the second direction. Each of the heat transfer fins is formed in a plate shape. The heat transfer fins extend along the third direction. The heat transfer fins are arranged at intervals along the second direction. A heat exchange space is a space formed by adjacent flat tubes and adjacent heat transfer fins. Each of the heat transfer fins has a heat transfer fin front side surface and a heat transfer fin back side surface. The heat transfer fin front side surface is one main surface of the heat transfer fin. The heat transfer fin back side surface is the other main surface of the heat transfer fin. Each of the heat transfer fins has a plurality of protrusions. Each of the protrusions is a bulging portion or a cut-and-raised portion protruding along the second direction from the heat transfer fin front side surface or from the heat transfer fin back side surface. The plurality of protrusions is arranged in the first direction in each heat exchange space. The plurality of protrusions includes leeward side protrusions and windward side protrusions. The leeward side protrusions are protrusions located on the leeward side. The windward side protrusions are protrusions located further to the windward side than the leeward side protrusions. According to an air flow directional view, in each heat exchange space, a ratio of an area of an "other-side-protrusion" occupying a reference area is equal to or greater than 0.2. The air flow directional view is a way to view from the windward side to the leeward side of the first direction. The reference area is, in the air flow directional view, an area of a quadrilateral configured by a lateral side and a longitudinal side. One of the lateral side and the longitudinal side is, in the air flow directional view, defined by a portion located between an one-side-protrusion's edge, which is arranged in the heat transfer fin front side surface or the heat transfer fin back side surface where the one-side-protrusion protrudes from, and a main surface of the flat tube closest to the one-side-protrusion's edge. Other one of the lateral side and the longitudinal side is, in the air flow directional view, defined by a fin pitch of the heat transfer fins. The one-side-protrusion is one of the windward side protrusions and the leeward side protrusions, and the other-side-protrusion is the other of the windward side protrusions and the leeward side protrusions.

In the heat exchanger according to the first example of one or more embodiments of the present invention, according to the air flow directional view, the ratio of the area of the other-side-protrusion occupying the reference area in each heat exchange space is equal to or greater than 0.2. The reference area is, in the air flow directional view, an area of a quadrilateral configured by a lateral side and a longitudinal side. One of the lateral side and the longitudinal side is, in the air flow directional view, defined by a portion located between an one-side-protrusion's edge, which is arranged in the heat transfer fin front side surface or the heat transfer fin back side surface where the one-side-protrusion protrudes from, and a main surface of the flat tube closest to the one-side-protrusion's edge. Other one of the lateral side and the longitudinal side is, in the air flow directional view, defined by a fin pitch of the heat transfer fins. Thus, when viewed from the air flow direction, in each heat exchange space, the formation of a large gap is restrained between the other-side-protrusion and the main surface of the flat tube. As a result, with respect to the air flow passing through the heat exchange space, the drift phenomenon in which the flow velocity of the air flow passing through the gap becomes significantly higher as compared with the flow velocity of the air flow passing through the periphery of the protrusion is unlikely to occur. In this regard, heat exchange between the air flow and the refrigerant in the flat tube is appropriately performed. Therefore the performance degradation is restrained.

A heat exchanger according to a second example of one or more embodiments of the present invention is the heat exchanger according to the first example of one or more embodiments of the present invention, wherein when the heat exchange space is viewed from the third direction, the other-side-protrusion is disposed at a position where a distance is greater than zero. The distance is provided between one which is closer to the flat tube out of an other-side-protrusion's windward side edge and an other-side-protrusion's leeward side edge and one which is closer to the other-side-protrusion out of a windward side end portion of the flat tube and a leeward side end portion of the flat tube.

Therefore, it is possible to increase the size of the other-side-protrusion. In other words, when viewed from the third direction, in a case where the other-side-protrusion is configured so that the distance provided between one which is closer to the flat tube out of an other-side-protrusion's windward side edge and an other-side-protrusion's leeward side edge and one which is closer to the other-side-protrusion out of a windward side end portion of the flat tube and a leeward side end portion of the flat tube is zero or less (that is, they are overlapping), it is difficult to dispose (cut up or bulge) the other-side-protrusion so that one, which is closer to the flat tube out of an other-side-protrusion's windward side edge and an other-side-protrusion's leeward side edge, overlaps with the flat tube in the air flow directional view. In this regard, it is difficult to increase the size of the other-side-protrusion to the extent to which the formation of the large gap between the other-side-protrusion and the main surface of the heat transfer tube is restrained when each of the heat exchange spaces is viewed from the air flow direction.

By disposing the other-side-protrusion at a position where, when viewed from the third direction, the distance is greater than zero between one which is closer to the flat tube out of an other-side-protrusion's windward side edge and an other-side-protrusion's leeward side edge and one which is closer to the other-side-protrusion out of a windward side end portion of the flat tube and a leeward side end portion of the flat tube, it is facilitates that the other-side-protrusion is configured and arranged so that one which is closer to the flat tube out of an other-side-protrusion's windward side edge and an other-side-protrusion's leeward side edge overlaps with the flat tube in the air flow directional view. Therefore, it is easy to configure the other-side-protrusion larger to the extent that the large gap, when each heat exchange space is viewed from the air flow direction, is not formed largely between the other-side-protrusion and the main surface of the heat transfer tube. That is, the ratio of the area of the other-side-protrusion occupying the reference area can be easily set to equal to or greater than 0.2. Therefore, the performance degradation can be further restrained.

A heat exchanger according to a third example of one or more embodiments of the present invention is the heat exchanger according to the first example or the second example of one or more embodiments of the present invention, wherein, in the air flow directional view, a length of which the other-side-protrusion protruding is equal to or longer than a length of which the one-side-protrusion protruding. This facilitates the configuration of the other-side-protrusion to be further larger. In other words, the ratio of the area of the other-side-protrusion occupying the reference area can easily be set to equal to or greater than 0.2. Therefore, the performance degradation can be further restrained.

A heat exchanger according to a fourth example of one or more embodiments of the present invention is the heat exchanger according to any one of the first example to the third example of one or more embodiments of the present invention, wherein the other-side-protrusion is disposed on the most windward side or the leeward side of the plurality of protrusions. This facilitates the configuration of the other-side-protrusion to be further larger. In other words, the ratio of the area of the other-side-protrusion occupying the reference area can easily be set to equal to or greater than 0.2. Therefore, the performance degradation can be further restrained.

A heat exchanger according to a fifth example of one or more embodiments of the present invention is the heat exchanger according to any one of the first example to the fourth example of one or more embodiments of the present invention, wherein the ratio of the area of the other-side-protrusion occupying the reference area is equal to or greater than 0.5. Thus, in each heat exchange space, when viewed from the air flow direction, the formation of the large gap between the other-side-protrusion and the main surface of the flat tube is further reduced. As a result, with respect to the air flow passing through the heat exchange space, the drift phenomenon in which the flow velocity of the air flow passing through the gap becomes significantly higher as compared with the flow velocity of the air flow passing through the periphery of the protrusion is more unlikely to occur. In this regard, in the heat exchange space, heat exchange between the air flow and the refrigerant in the flat tube is further facilitated to be appropriately performed. Therefore, the performance degradation is further restrained.

A heat exchanger according to a sixth example of one or more embodiments of the present invention is the heat exchanger according to any one of the first example to the fifth example of one or more embodiments of the present invention, wherein the plurality of protrusion configured to include a strength enhancement protrusion. The strength enhancement protrusion configured and arranged to extend from one end side in the first direction towards the other end side in the first direction of the heat transfer fin. The strength enhancement protrusion increases the strength of the heat transfer fin.

Thus, when a load is applied to the heat transfer fin (particularly when a load is applied along the first direction or the opposite direction thereto), the deformation and buckling of the heat transfer fin is restrained. As a result, the performance degradation of the heat exchanger due to deformation and buckling of the heat transfer fin is restrained. Therefore, the performance degradation is further restrained.

A heat exchanger according to a seventh example of one or more embodiments of the present invention is the heat exchanger according to the sixth example of one or more embodiments of the present invention, wherein the heat transfer fin is formed with a plurality of flat tube insertion holes. The flat tube insertion holes extend from one end side towards the other end side in the first direction of the heat transfer fin. The flat tube insertion hole is a hole into which the flat tube is inserted. When viewed from the third direction, an terminal end of the strength enhancement protrusion is positioned further to one end side in the first direction of the heat transfer fin than the flat tube insertion hole.

Thus, particularly, when a load is applied to the heat transfer fin from the side opposite to the side where the flat tube is inserted, deformation or buckling of the heat transfer fin is restrained. As a result, even when a load is applied from the side opposite to the side where the flat tube of the heat transfer fin is inserted, for example, during the manufacturing process of the heat exchanger such as bending process or at the time transportation or the like, deformation or buckling of the heat transfer fin is restrained. Therefore, the performance degradation of the heat exchanger is restrained.

A heat exchanger according to an eighth example of one or more embodiments of the present invention is the heat exchanger according to the sixth example of one or more embodiments of the present invention, wherein the heat transfer fin is formed with a plurality of flat tube insertion holes. The flat tube insertion holes extend from one end side towards the other end side in the first direction of the heat transfer fin. The flat tube insertion holes are each a hole into which the flat tube is inserted. when viewed from the third direction, a tip end of the strength enhancement protrusion is positioned further to the other end side in the first direction of the heat transfer fin than the flat tube insertion hole.

Thus, particularly, when a load is applied to the heat transfer fin from the side opposite to the side where the flat tube is inserted, deformation or buckling of the heat transfer fin is restrained. As a result, even when a load is applied from the side opposite to the side where the flat tube of the heat transfer fin is inserted, for example, during the manufacturing process of the heat exchanger such as bending process or at the time transportation or the like, deformation or buckling of the heat transfer fin is restrained. Therefore, the performance degradation of the heat exchanger is restrained.

A heat exchanger according to a ninth example of one or more embodiments of the present invention is the heat exchanger according to any one of the sixth example to the eighth example of one or more embodiments of the present invention, wherein the heat transfer fin configured to include a fin main body. The fin main body is a portion configured and arranged to extend continuously from one end side in the third direction to the other end side in the third direction of the heat transfer fin. The strength enhancement protrusion is partially or entirely disposed on the fin main body.

Thus, deformation or buckling of the heat transfer fin is restrained when a load is applied to the heat transfer fin, particularly the fin main body. As a result, even when a load is applied to the fin main body, for example, during the manufacturing process of the heat exchanger such as bending process or at the time of transportation or the like, deformation or buckling of the heat transfer fin is restrained. Therefore, the performance degradation of the heat exchanger is restrained.

A heat exchanger according to a tenth example of one or more embodiments of the present invention is the heat exchanger according to any one of the sixth example to the ninth example of one or more embodiments of the present invention, wherein. when viewed from the third direction, the strength enhancement protrusion is partially or entirely disposed between the one-side-protrusion and the other-side-protrusion. Thus, it is possible that the strength enhancement protrusion to be disposed in the space formed between the one-side-protrusion and the other-side-protrusion. As a result, the strength enhancement protrusion can coexist with other protrusion in the narrow heat exchange space.

A heat exchanger according to an eleventh example of one or more embodiments of the present invention is the heat exchanger according to any one of the sixth example to the tenth example of one or more embodiments of the present invention, wherein the strength enhancement protrusion is configured integrally with the other-side-protrusion. Due to constituting the strength enhancement protrusion integrally with the other-side-protrusion, it is possible that the strength enhancement protrusion and the other-side-protrusion to coexist in a narrow heat exchange space.

In the heat exchanger according to the first aspect of one or more embodiments of the present invention, when viewed from the air flow direction, in each heat exchange space, the formation of a large gap is restrained between the other-side-protrusion and the main surface of the flat tube. As a result, with respect to the air flow passing through the heat exchange space, the drift phenomenon in which the flow velocity of the air flow passing through the gap becomes significantly higher as compared with the flow velocity of the air flow passing through the periphery of the protrusion is unlikely to occur. In this regard, heat exchange between the air flow and the refrigerant in the flat tube is appropriately performed. Therefore the performance degradation is restrained.

In the heat exchanger according to the second to the fourth example of one or more embodiments of the present invention, the ratio of the area of the other-side-protrusion occupying the reference area can be easily set to equal to or greater than 0.2. Therefore, the performance degradation can be further restrained.

In the heat exchanger according to the fifth example of one or more embodiments of the present invention, heat exchange between the air flow and the refrigerant in the flat tube is further facilitated to be appropriately performed. Therefore, the performance degradation is further restrained.

In the heat exchanger according to the sixth example of one or more embodiments of the present invention, when a load is applied to the heat transfer fin (particularly when a load is applied along the first direction or the opposite direction thereto), the deformation and buckling of the heat transfer fin is restrained. As a result, the performance degradation of the heat exchanger due to deformation and buckling of the heat transfer fin is restrained. Therefore, the performance degradation is further restrained.

In the heat exchanger according to the seventh example or the eighth example of one or more embodiments of the present invention, particularly, when a load is applied to the heat transfer fin from the side opposite to the side where the flat tube is inserted, deformation or buckling of the heat transfer fin is restrained. As a result, even when a load is applied from the side opposite to the side where the flat tube of the heat transfer fin is inserted, for example, during the manufacturing process of the heat exchanger such as bending process or at the time transportation or the like, deformation or buckling of the heat transfer fin is restrained. Therefore, the performance degradation of the heat exchanger is restrained.

In the heat exchanger according to the ninth example of one or more embodiments of the present invention, deformation or buckling of the heat transfer fin is restrained when a load is applied to the heat transfer fin, particularly the fin main body. As a result, even when a load is applied to the fin main body, for example, during the manufacturing process of the heat exchanger such as bending process or at the time of transportation or the like, deformation or buckling of the heat transfer fin is restrained. Therefore, the performance degradation of the heat exchanger is restrained.

In the heat exchanger according to the tenth example or the eleventh example of one or more embodiments of the present invention, it is possible for the strength enhancement protrusion to coexist with the other protrusion in the narrow heat exchange space.

DETAILED DESCRIPTION

Hereinafter, a heat exchanger 21 according to one or more embodiments of the present invention will be described with reference to the drawings. Note that the following embodiments are specific examples of the heat exchanger according to the present invention and are not limited to the technical scope of the present invention, but modifications can be appropriately made herein without departing from the scope of the invention. In the following embodiments, in FIGS. 1 to 10, FIGS. 12 to 17, and FIGS. 19 to 21, an "x" direction corresponds to a left-right direction, a "y" direction corresponds to a front-back direction, and a "z" direction corresponds to an up-down direction. In addition, a direction in which an air flow AF flows when passing through a heat exchanger 21 (more specifically, heat exchange spaces SP to be described later) is referred to as "air flow direction dr1". In one or more embodiments, the air flow direction dr1 (corresponding to the "first direction" described in the claims) corresponds to the "x" direction (that is, the left-right direction) or the "y" direction (that is, the front-back direction). Also, a viewpoint of the air flow direction dr1 as viewed from the windward side to the leeward side is referred to as "air flow directional view v1".

(1) Heat Exchanger 21

(1-1) Heat Exchange Unit 40

The heat exchanger 21 has multiple (four, in this case) heat exchange units 40 for exchanging heat between the air flow AF and the refrigerant. Each of the heat exchange units 40 is a region widening in a direction intersecting the traveling direction of the air flow AF (that is, the air flow direction dr1), and extending along the "x" direction or the "y" direction in a plan view as well as extending in the "z" direction in a side view (refer to FIG. 1 and FIG. 2). In one or more embodiments, the heat exchanger 21 is integrally configured by connecting each of the heat exchange units 40 to any of the other heat exchange units 40.

As shown in FIGS. 1 to 6, each of the heat exchange units 40 includes multiple heat transfer tubes 50 through which a refrigerant flows, and multiple heat transfer fins 60 for promoting the heat exchange between the refrigerant in the heat transfer tubes 50 and the air flow AF.

Figure 4:
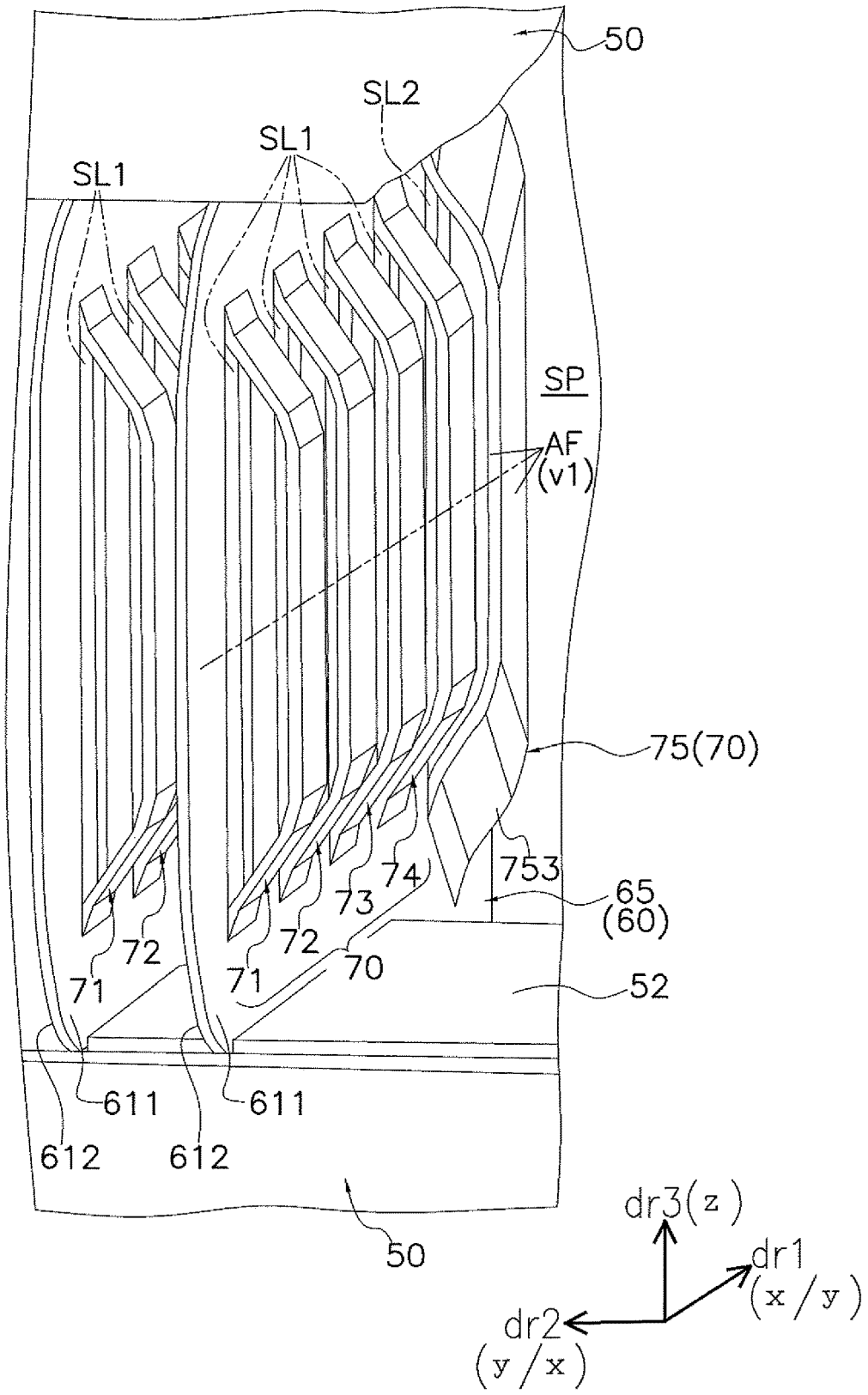
FIG. 4 is an enlarged perspective view of a portion IV in FIG. 3.

In the following description, a direction in which the heat exchange unit 40 extends in a plan view (that is, when viewed from the "z" direction) is referred to as a "heat transfer tube extending direction dr2", and a direction in which the heat exchange unit 40 extends in a side view (that is, when viewed from the "x" direction or the "y" direction) is referred to as a "heat transfer fin extending direction dr3" (refer to FIGS. 4 to 6, etc.). The heat transfer tube extending direction dr2 (corresponding to the "second direction" described in the claims) is a direction intersecting the air flow direction dr1 and the heat transfer fin extending direction dr3 and corresponds to the "y" direction or the "x" direction. The heat transfer fin extending direction dr3 (corresponding to the "third direction" described in the claims) is a direction intersecting the air flow direction dr1 and corresponds to the "z" direction.

(1-2) Heat Transfer Tubes 50

The heat transfer tubes 50 are each a so-called flat perforated tube in which a plurality of refrigerant channels 51 is formed. Each of the heat transfer tubes 50 have a thin plate shape and includes two main surfaces 52 (specifically, a heat transfer tube front side surface 521 and a heat transfer tube back side surface 522) (refer to FIG. 2, etc.). The heat transfer tube 50 is made of aluminum or an aluminum alloy. The heat transfer tubes 50 extend along the heat transfer tube extending direction dr2. That is, in each of the heat transfer tubes 50, the refrigerant channels 51 extend along the heat transfer tube extending direction dr2, and the refrigerant flows along the heat transfer tube extending direction dr2.

Figure 1:
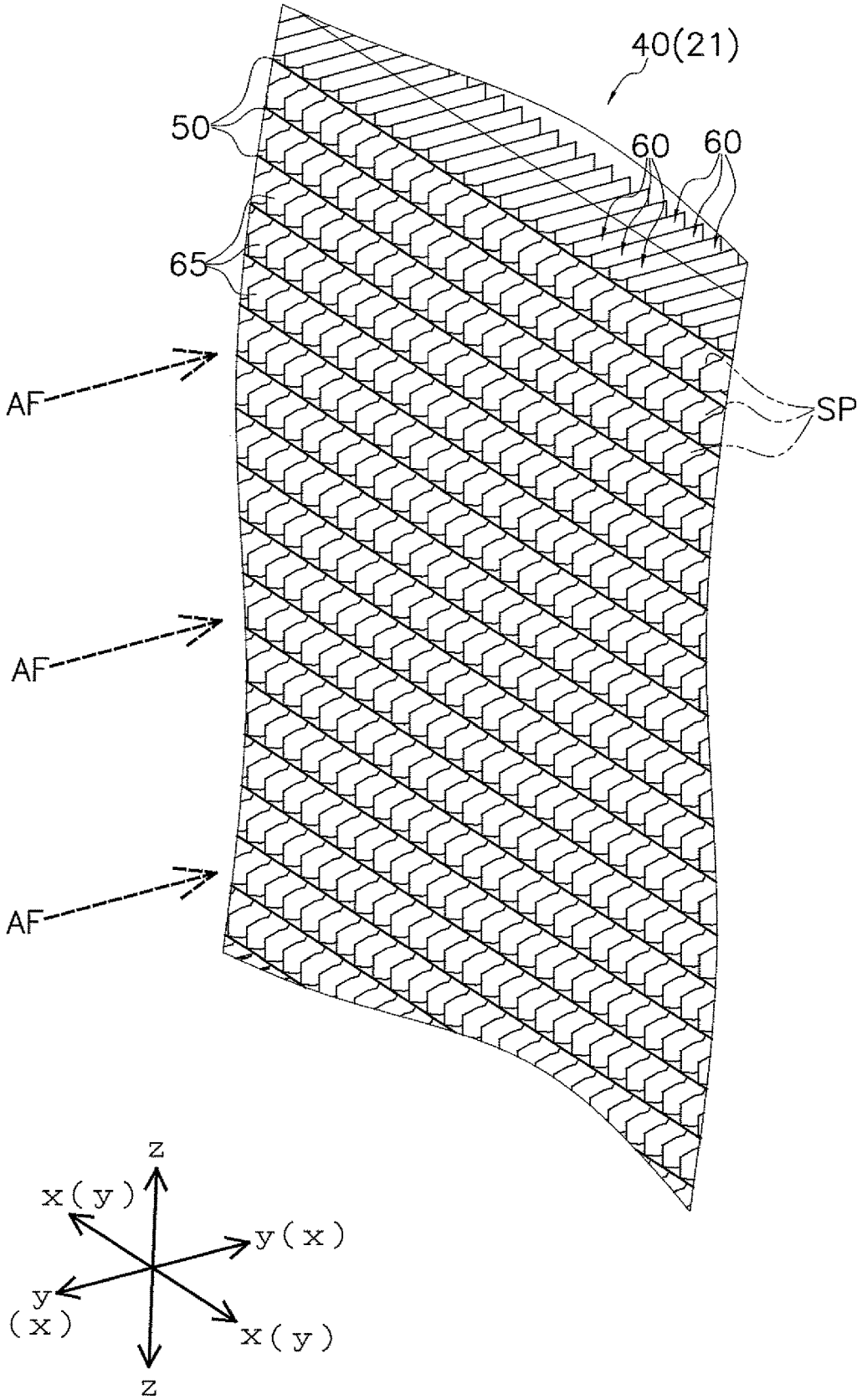
FIG. 1 is a perspective view of a heat exchange unit of a heat exchanger according to one or more embodiments of the present invention.
Figure 2:
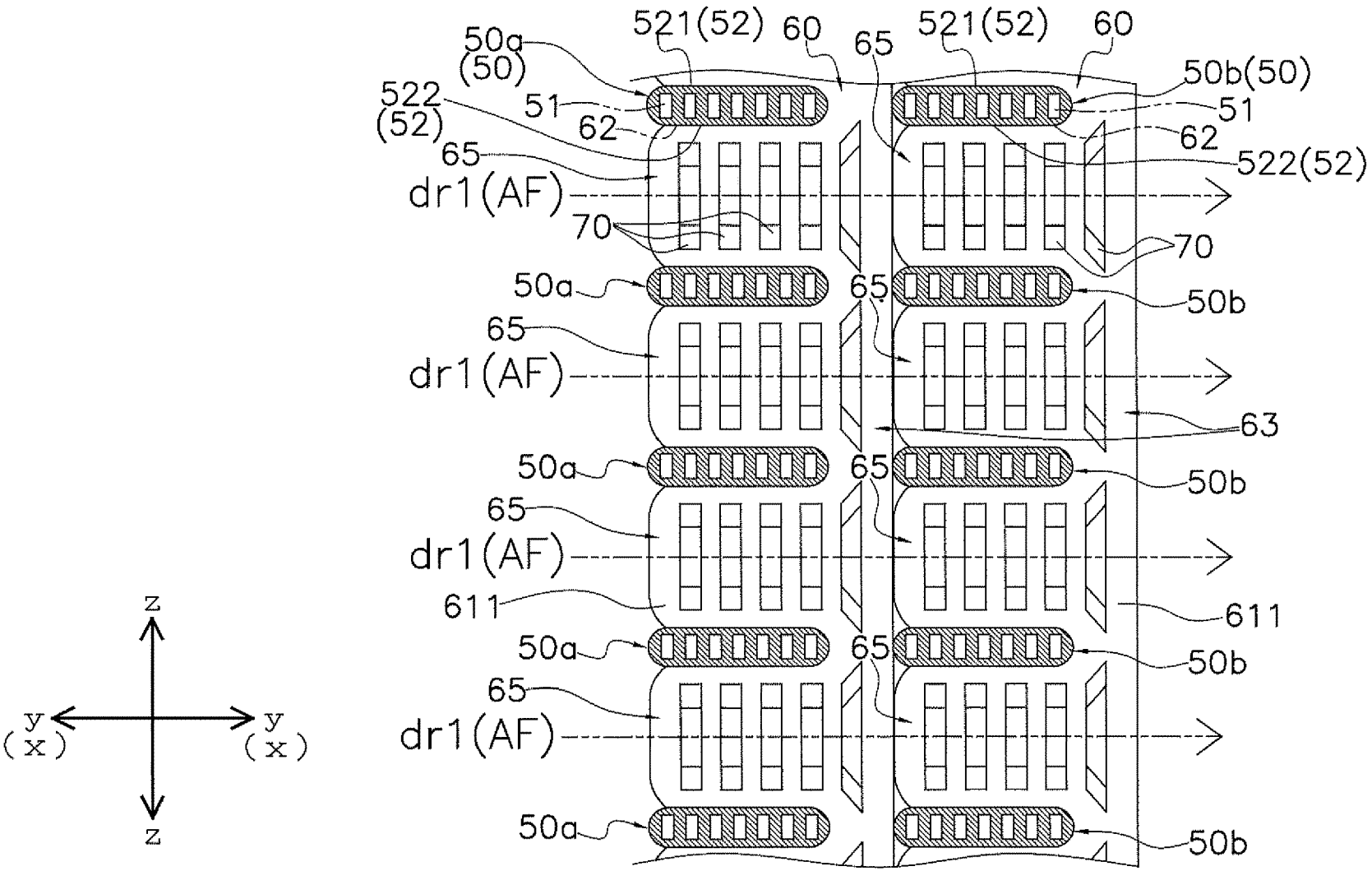
FIG. 2 is a schematic diagram illustrating a cross section of the heat exchange unit according to one or more embodiments.
Figure 3:
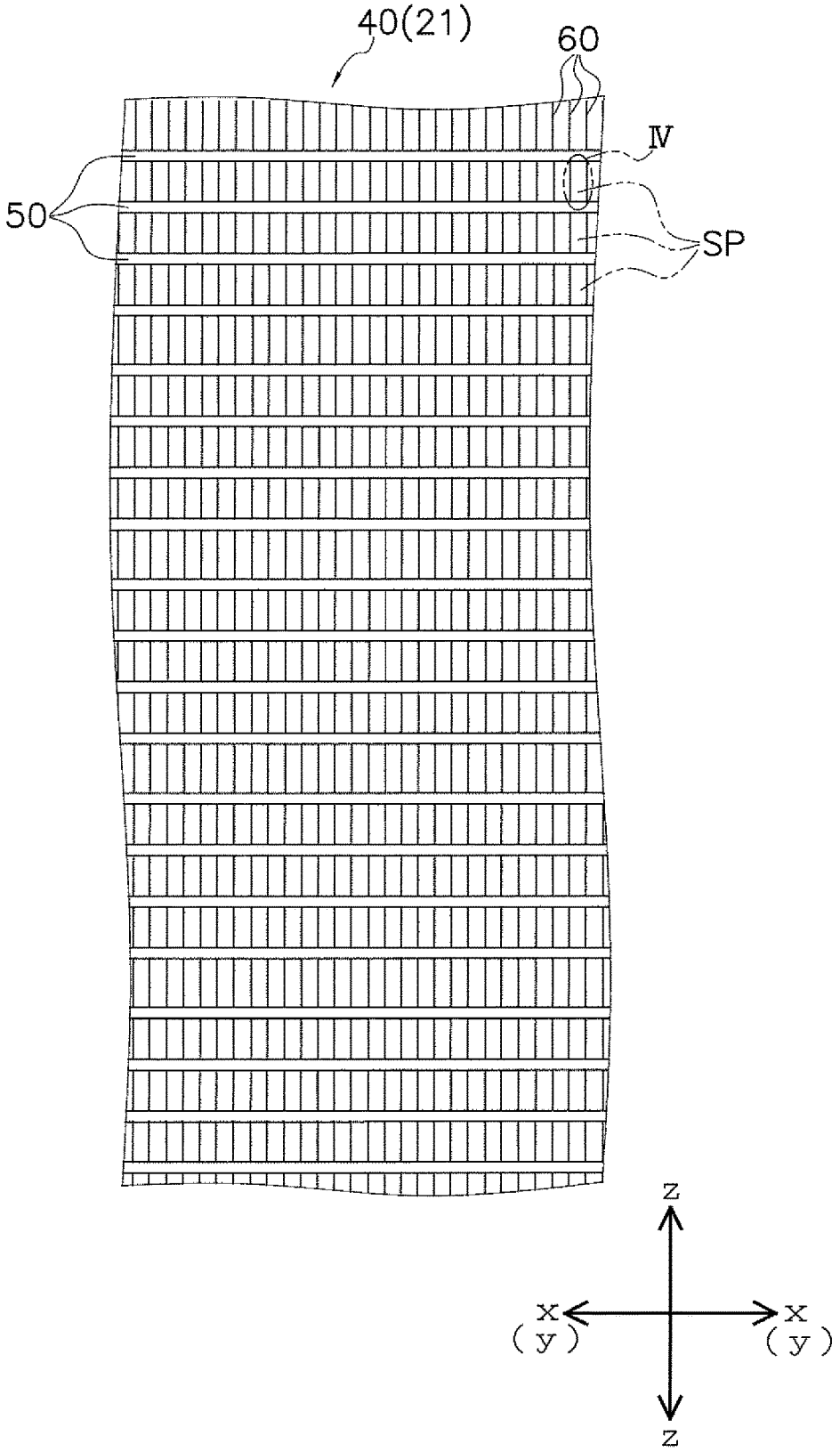
FIG. 3 is a schematic diagram illustrating a state of the heat exchange unit shown in FIG. 1 as viewed from an air flow direction.

In the respective heat exchange unit 40, each of the heat transfer tubes 50 is arranged parallel with the other heat transfer tubes 50 at intervals along the heat transfer fin extending direction dr3 (refer to FIGS. 1 to 3, etc.). Each of the heat transfer tubes 50 is arranged with other heat transfer tubes 50 in two rows at intervals along the air flow direction dr1 (refer to FIG. 1 and FIG. 2). That is, in the heat exchange unit 40, the heat transfer tubes 50 extending along the heat transfer tube extending direction dr2 are arranged in two rows along the air flow direction dr1. Also, a plurality of the set of heat transfer tubes 50 arranged in two rows in the air flow direction dr1 is aligned along the heat transfer fin extending direction dr3. Note that the rows and the number of the heat transfer tubes 50 included in the heat exchange unit 40 can be appropriately changed in accordance with design specifications.

Here, regarding the heat transfer tubes 50 arranged in two rows, the heat transfer tubes 50 located on the windward side of the air flow AF are referred to as a windward side heat transfer tubes 50*a*, and the heat transfer tubes 50 located on the leeward side of the air flow AF are referred to as a leeward side heat transfer tubes 50*b*.

(1-3) Heat Transfer Fin 60

Heat transfer fins 60 are flat plate shaped members for increasing the heat transfer area between the heat transfer tubes 50 and the air flow AF. The heat transfer fins 60 are made of aluminum or an aluminum alloy. The heat transfer fins 60 each include two main surfaces (specifically, a fin front side surface 611 and a fin back side surface 612) (refer to FIGS. 4 to 6). In the heat exchange unit 40, the heat transfer fins 60 extend along the heat transfer fin extending direction dr3 (here, the z direction) so as to intersect the heat transfer tubes 50 (refer to FIGS. 1 to 3, etc.). The heat transfer fins 60 are formed with a plurality of slits 62 arranged side by side at intervals along the heat transfer fin extending direction dr3. The heat transfer tubes 50 are respectively inserted into the slits 62 (refer to FIG. 2). In other words, each of the slits 62 is a hole that extends from one end side towards the other end side in the air flow direction dr1 of the heat transfer fin 60 and into which the heat transfer tube 50 is inserted.

In the heat exchange unit 40, each of the heat transfer fins 60 is arranged at intervals (hereinafter that interval is referred to as "fin pitch P1") together with the other heat transfer fins 60 along the heat transfer tube extending direction dr2 (refer to FIGS. 1 to 6). In addition, each of the heat transfer fins 60 is arranged with the other heat transfer fins 60 in two rows at intervals in the air flow direction dr1 (refer to FIG. 2). That is, in the heat exchange unit 40, the heat transfer fins 60 extending along the direction (the heat transfer fin extending direction dr3) intersecting with the direction in which the heat transfer tubes 50 extend (the heat transfer tube extending direction dr2) are arranged in two rows along the air flow direction (air flow direction dr1). Also, pairs of the heat transfer fins 60 arranged in two rows along the air flow direction dr1 are arranged such that a large number of heat transfer fins 60 are aligned along the heat transfer tube extending direction dr2. Note that the number of the heat transfer fins 60 included in the heat exchange unit 40 is selected according to the length of the heat transfer tube extending direction dr2 of the heat transfer tubes 50 and can be appropriately selected and changed according to the design specifications.

As shown in FIG. 2 and the like, each of the heat transfer fins 60 includes a fin main body 63 and a plurality of heat transfer promoting portions 65 extending from the leeward side toward the windward side in the air flow direction dr1 from the fin main body 63.

(1-3-1) Fin Main Body 63

The fin main body 63 is a portion extending continuously from one end side to the other end side of the heat transfer fin 60 in the heat transfer fin extending direction dr3. The fin main body 63 extends continuously along the heat transfer fin extending direction dr3. A length dimension of the fin main body 63 in the heat transfer fin extending direction dr3 is selected to be a size corresponding to the number of the heat transfer tubes 50 included in the heat exchange unit 40, and corresponds to a length dimension of the heat exchange unit 40 in the heat transfer fin extending direction dr3.

In the fin main body 63, the heat transfer promoting portions 65 of number corresponding to the number of the heat transfer tubes 50 included in the heat exchange unit 40 are arranged at intervals along the heat transfer fin extending direction dr3.

(1-3-2) Heat Transfer Promoting Portion 65

The heat transfer promoting portion 65 is a surface portion extending between two adjacent slits 62 (that is, between two adjacent heat transfer tubes 50 along the heat transfer fin extending direction dr3). When viewed from the heat transfer tube extending direction dr2, the heat transfer promoting portion 65 extends in a continuous manner along the air flow direction dr1 and the heat transfer fin extending direction dr3 between the main surfaces 52 of two heat transfer tubes 50 adjacent to each other in the heat transfer fin extending direction dr3

(that is, the heat transfer promoting portion 65 extends between the heat transfer tube front side surface 521 of one heat transfer tube 50 and the heat transfer tube back side surface 522 of the other heat transfer tube 50). The heat transfer promoting portion 65 is in contact with the main surfaces 52 of the heat transfer tubes 50 at the boundary portion (edge portion) with the slit 62. As shown in FIG. 2 and FIGS. 4 to 6, the heat transfer promoting portion 65 is provided with multiple protrusions 70 (five in this case) for promoting heat exchange between the air flow AF and the refrigerant in the heat transfer tubes 50.

Each of the protrusions 70 protrudes from the fin front side surface 611 toward the fin back side surface 612 of the other heat transfer fin 60 facing the fin front side surface 611 (that is, toward the heat transfer tube extending direction dr2). Each protrusion 70 is formed by cutting and raising a portion of the heat transfer promoting portion 65 along the heat transfer tube extending direction dr2 (that is, a direction intersecting the air flow direction dr1).

Specifically, in the heat transfer promoting portion 65, a first protrusion 71, a second protrusion 72, a third protrusion 73, a fourth protrusion 74, and a fifth protrusion 75 are provided as the protrusions 70. In the heat transfer promoting portion 65, the protrusions 70 are formed in the order of the first protrusion 71, the second protrusion 72, the third protrusion 73, the fourth protrusion 74, and the fifth protrusion 75 from the windward side to the leeward side in the air flow direction dr1 (refer to FIG. 5). Each protrusion 70 exhibits a trapezoidal shape according to the air flow directional view v1 (refer to FIG. 6).

Figure 5:
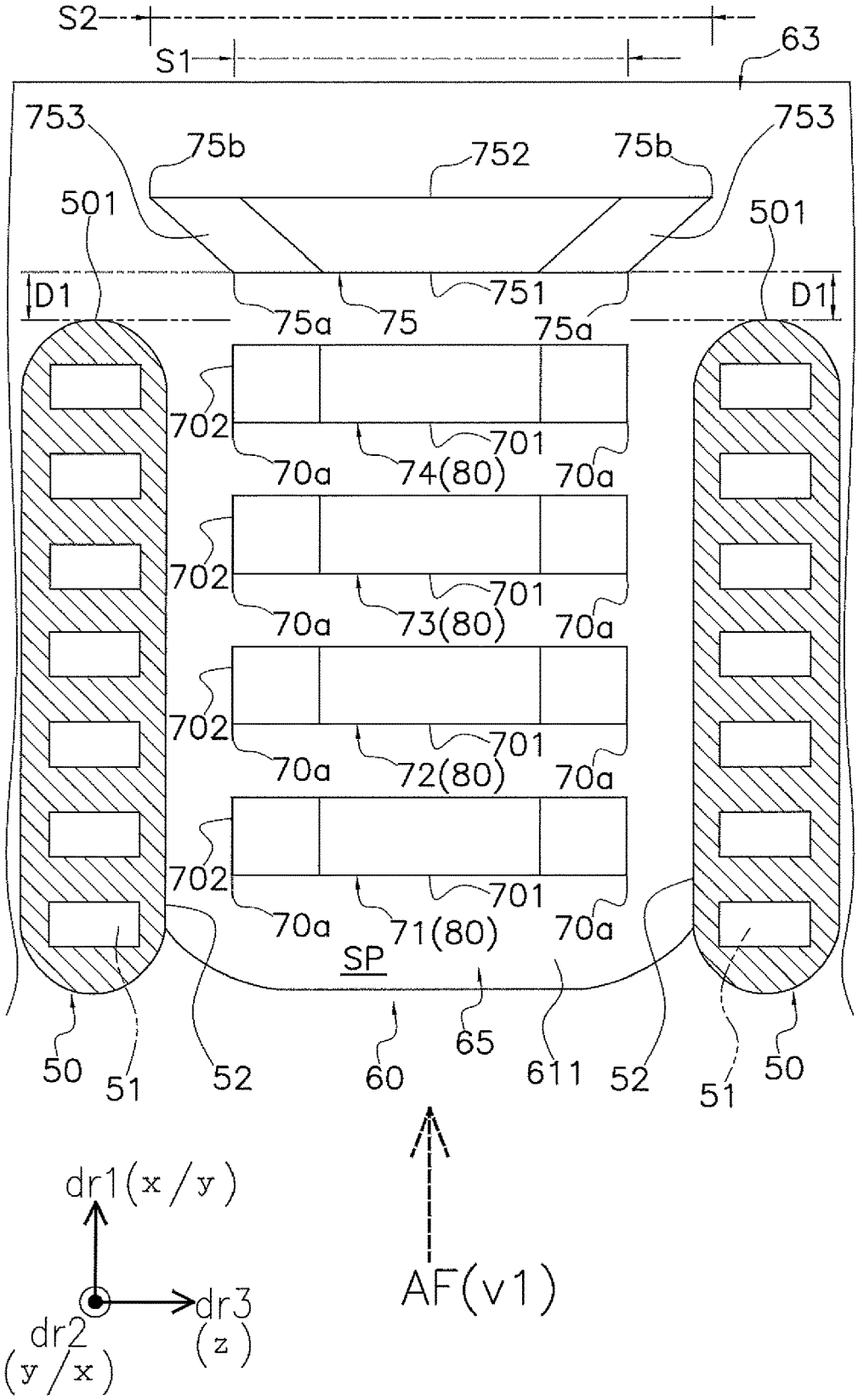
FIG. 5 is a schematic diagram schematically showing a state of a heat exchange space shown in FIG. 4 as viewed from a heat transfer tube extending direction.
Figure 6:
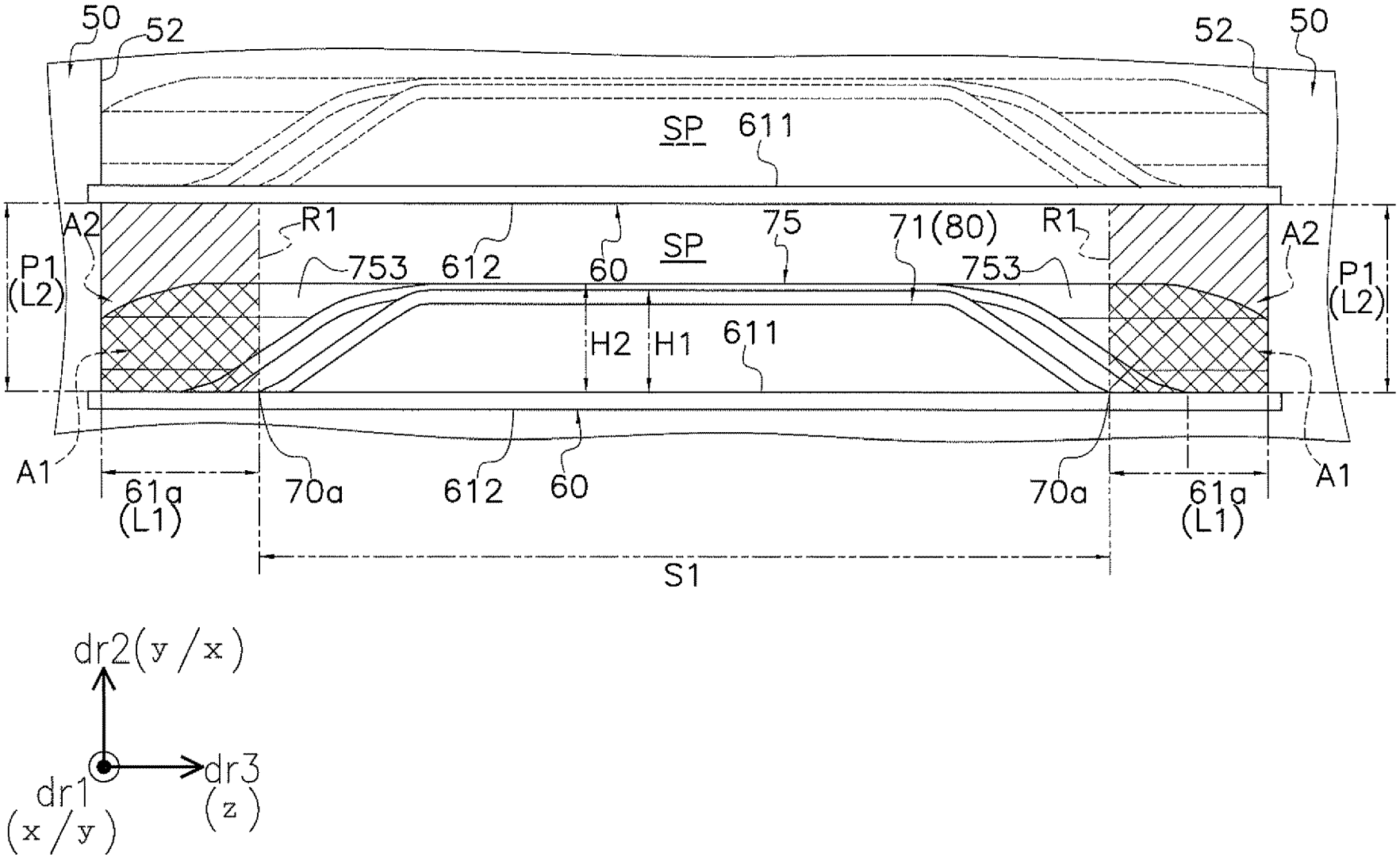
FIG. 6 is a schematic diagram schematically showing a state of the heat exchange space shown in FIG. 4 as viewed from the air flow direction.

When viewed from the heat transfer tube extending direction dr2, the first protrusion 71, the second protrusion 72, the third protrusion 73, and the fourth protrusion 74 exhibit a rectangular shape having a dimension in the heat transfer fin extending direction dr3 as a long side 701 and a dimension of the air flow direction dr1 as a short side 702 (refer to FIG. 5). The first protrusion 71, the second protrusion 72, the third protrusion 73, and the fourth protrusion 74, hereinafter, are referred to as "one-end-side-protrusions 80". The length dimension S1 of the long side 701 in each one-end-side-protrusion 80 is substantially same with that of other one-end-side-protrusion 80 (refer to FIG. 5 and FIG. 6). The length dimension of the short side 702 in each one-end-side-protrusion 80 is substantially same with that of other one-end-side-protrusion 80 (refer to FIG. 5 and FIG. 6). Therefore, when viewed from the heat transfer tube extending direction dr2, the sizes of the one-end-side-protrusions 80 (or the sizes of a slits SL1 formed by the one-end-side-protrusions 80) are substantially the same. In addition, a length dimension H1 that is a length each of the one-end-side-protrusions 80 protrudes toward the heat transfer tube extending direction dr2 is substantially same with that of the other one-end-side-protrusions (refer to FIG. 6).

It is to be noted that in one or more embodiments, at least one of the one-end-side-protrusions 80 (the first protrusion 71 to the fourth protrusion 74) correspond to the "one-side-protrusion" described in the claims.

The fifth protrusion 75 (corresponding to the "leeward side protrusion" described in the claims) includes an upper side 751 (short side) and a lower side 752 (long side) extending, when viewed from the heat transfer tube extending direction dr2, along the heat transfer fin extending direction dr3. The fifth protrusion 75 exhibits, when viewed from the heat transfer tube extending direction dr2, a trapezoidal shape in which the upper side 751 is located on the windward side in the air flow direction dr1 and the lower side 752 is located on the leeward side thereof (refer to FIG. 5). In relation to this, according to the air flow directional view v1, the fifth protrusion 75 protrudes toward the heat transfer tube extending direction dr2 so as to have two inclined faces 753 that are located near both ends in the heat transfer fin extending direction dr3 and face the windward side direction of the air flow AF.

When viewed from the heat transfer tube extending direction dr2, the size of the fifth protrusion 75 (or the size of a slit SL 2 formed by providing the fifth protrusion 75) is larger than the size of the respective one-end-side-protrusions 80 (or the size of the slit SL1). That is, the fifth protrusion 75 is cut and raised so that the length dimension in the heat transfer fin extending direction dr3 is larger, in the air flow directional view v1, than that of each one-end-side-protrusions 80.

In relation to this, a length dimension H2 (refer to FIG. 6) at which the fifth protrusion 75 protrudes toward the heat transfer tube extending direction dr2 is larger than the length dimension H1. That is, the fifth protrusion 75 is cut and raised high from the fin front side surface 611 along the heat transfer tube extending direction dr2 so that the protruding length dimension (H2) is larger than the protruding length dimension of each one-end-side-protrusions 80.

Also, as shown in FIG. 5, the length dimension S2 of the long side (lower side 752) of the fifth protrusion 75 is larger than the length dimension S1 of the long side 701 of each one-end-side-protrusions 80. Related to this, a width of the fifth protrusion 75 is larger, when viewed from the air flow direction dr1, than the widths of each one-end-side-protrusions 80 (refer to FIG. 6).

Note that in one or more embodiments, the fifth protrusion 75 corresponds to the "other-side-protrusion" described in the claims.

(1-4) Heat Exchange Spaces SP

A large number of heat exchange spaces SP are formed in each heat exchange unit 40 (refer to FIGS. 3 to 6). The heat exchange space SP is a space through which the air flow AF flowing along the air flow direction dr1 passes. Also, the heat exchange space SP is a space where heat exchange is performed between the air flow AF and the refrigerant in the heat transfer tubes 50. Each of the heat exchange spaces SP is formed by the heat transfer tubes 50 adjacent to each other in the heat transfer fin extending direction dr3 and the heat transfer fins 60 adjacent to each other in the heat transfer tube extending direction dr2.

In each of the heat exchange spaces SP, the heat transfer promoting portion 65 extends along the air flow direction dr1 and the heat transfer fin extending direction dr3. Also, in each of the heat exchange spaces SP, each of the protrusions 70 of the heat transfer promoting portions 65 protrudes from the fin front side surface 611 along the heat transfer tube extending direction dr2 (the direction intersecting the air flow direction dr1). Each protrusion 70 plays a role of increasing the heat transfer area when the air flow AF passes through the heat exchange spaces SP to thereby promote heat exchange between the air flow AF and the refrigerant in the heat transfer tubes 50.

In the heat exchange spaces SP, each protrusion 70 of each of the heat transfer fins 60 protrudes from the fin front side surface 611 toward the fin back side surface 612 of the other heat transfer fin 60 facing the relevant fin front side surface 611. That is, each protrusion 70 protrudes in the direction of the heat transfer tube extending direction dr2 intersecting the air flow direction dr1 (refer to FIG. 6).

As described above, since the length dimension H1 at which each of the one-end-side-protrusions 80 (the first protrusion 71, the second protrusion 72, the third protrusion 73, and the fourth protrusion 74) protrudes is substantially the same with other, according to the air flow directional view v1, in the heat exchange spaces SP, the second protrusion 72, the third protrusion 73, and the fourth protrusion 74 overlap the first protrusion 71 located on the most windward side. In addition, since the protruding length dimension H2 of the fifth protrusion 75 is larger than the protruding length dimensions H1 of the one-end-side-protrusions 80, according to the air flow directional view v1, in the heat exchange spaces SP, the fifth protrusion 75 protrudes significantly toward the heat transfer tube extending direction dr2 than the one-end-side-protrusions 80.

In addition, when viewed from the heat transfer tube extending direction dr2, the leeward side edges 75*b* (the edges at both ends of the lower side 752) of the fifth protrusion 75 are located further outward than windward side edges 75*a* (the edges at both ends of the upper side 751) of the fifth protrusion 75. Thus, according to the air flow directional view v1, in the heat exchange spaces SP, the two inclined faces 753 of the fifth protrusion 75 protrude so as to face the windward side direction of the air flow AF at the outer side of the one-end-side-protrusions 80.

Given this configuration in which each of the protrusions 70 (particularly, the fifth protrusion 75) is disposed in the heat exchange spaces SP, according to the air flow directional view v1, a ratio of an area (hereinafter referred to as "protruding area A1") occupied by the fifth protrusion 75, particularly the inclined surface 753, in each of the heat exchange spaces SP is large. Specifically, the ratio of the protruding area A1 occupying an area of a virtual reference quadrilateral R1 (refer to FIG. 6) formed in each of the heat exchange spaces SP (hereinafter referred to as "reference area A2") is equal to or greater than 0.5 (that is, equal to or greater than 0.2).

The reference quadrilateral R1 is, in the heat exchange space SP, a quadrilateral configured to have a first side L1 (one of the longitudinal side or the lateral side) and a second side L2 (the other of the longitudinal side or the lateral side). The first side L1 is defined by a length dimension of a portion (refer to the reference numeral "61*a*" in FIG. 6) located between one edge 70*a* (the edge at one end of the long side 701) of the one-end-side-protrusions 80 of the fin front side surface 611 and the main surfaces 52 of the heat transfer tubes 50 closest to the relevant edge 70*a*. The second side L2 is defined by a length dimension of the fin pitch P1. The reference quadrilateral R1 is a region that is assumed to be a portion where the flow velocity is particularly likely to be increased (that is, a portion prone to drift phenomenon) when the air flow AF passes through each of the heat exchange spaces SP.

When each of the heat exchange spaces SP is viewed from the heat transfer fin extending direction dr3, a distance D1 between the edge 75*a* of the windward side of the fifth protrusion 75 and an end portion 501 at the most leeward side of the heat transfer tube 50 (that is, a leeward side edge of the slit 62 of the heat transfer fin 60) is greater than zero. In this regard, according to the air flow directional view v1, the fifth protrusion 75 is disposed such that the leeward side edge 75*b* thereof is positioned further to the leeward side than the heat transfer tubes 50 in each of the heat exchange spaces SP (refer to FIGS. 5 and 6). That is, according to the air flow directional view v1, the fifth protrusion 75 is disposed such that to overlap the heat transfer tubes 50.

In the heat exchange spaces SP, disposing the fifth protrusion 75 in such a manner increases the protruding area A1 in the reference area A2, (specifically, so as to be equal to or greater than 0.2), thereby configuring the fifth protrusion 75 to be larger. In other words, when each of the heat exchange spaces SP is viewed from the heat transfer fin extending direction dr3, in a case where the distance D1 between the edge 75*a* of the windward side of the fifth protrusion 75 and the end portions 501 of the heat transfer tubes 50 (that is, the leeward side edge of the slit 62) is zero or less, it is difficult to configure the fifth protrusion 75 to be large in order to increase the protruding area A1 in the reference area A2. Therefore, the fifth protrusion 75 is configured in such a manner as described above to thereby facilitate the configuration of a large fifth protrusion 75. That is, the fifth protrusion 75 is configured so as to facilitate the enlargement of the protruding area A1 in the reference area A2.

(2) Heat Transfer Promotion Function of the Heat Exchanger 21

The heat transfer promotion function of the heat exchanger 21, together with the principle of occurrence of the drift phenomenon of the air flow AF in each of the heat exchange spaces SP, will be described with reference to FIGS. 7 to 11. Note that the analysis results and data shown in FIGS. 7 to 11 are those that have been clarified by the inventor of the present invention after extensive studies.

Figure 7:
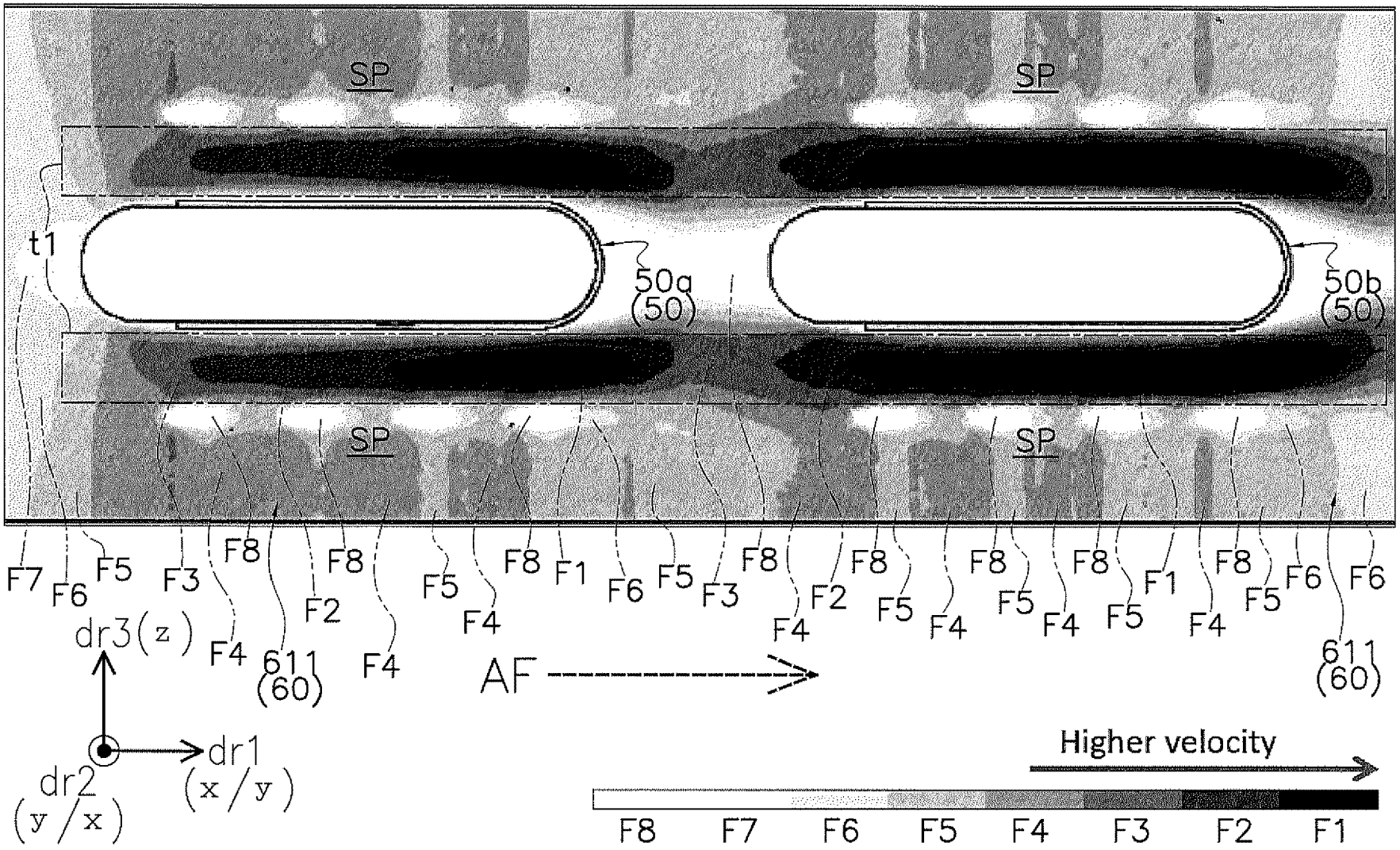
FIG. 7 is a schematic diagram illustrating a comparative example of a flow velocity distribution of an air flow in a case where a ratio of a protruding area occupying in a reference area in the heat exchange space is less than 0.2.
Figure 8:
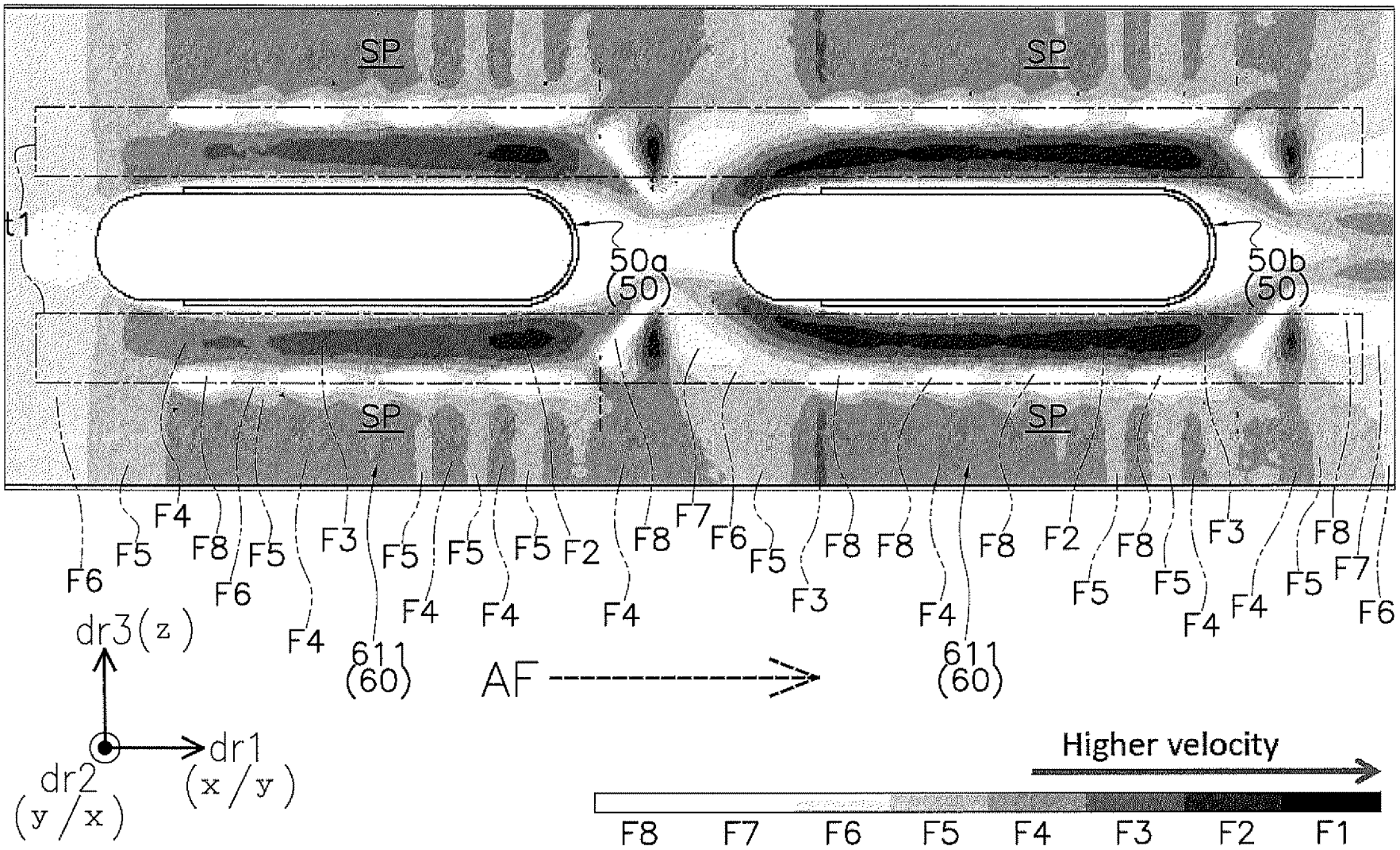
FIG. 8 is a schematic diagram illustrating an example of a flow velocity distribution of an air flow in a case where the ratio of the protruding area occupying in the reference area in the heat exchange space is equal to or greater than 0.2 according to one or more embodiments.

FIG. 7 is a schematic diagram showing an example of a flow velocity distribution of the air flow AF when the ratio of the protruding area A1 occupying in the reference area A2 in each of the heat exchange spaces SP is less than 0.2. FIG. 8 is a schematic diagram showing an example of the flow velocity distribution of the air flow AF when the ratio of the protruding area A1 occupying in the reference area A2 in each of the heat exchange spaces SP is equal to or greater than 0.2 (more specifically, equal to or greater than 0.5). In FIG. 7 and FIG. 8, the flow velocity distribution is mainly divided into regions of F1 to F8 according to the degree of the flow velocity of the air flow AF, and the black concentration (density) is shown more largely in the order of F1>F2>F3>F4>F5>F6>F7>F8, indicating that the flow velocity of the air flow AF is higher.

Figure 9:
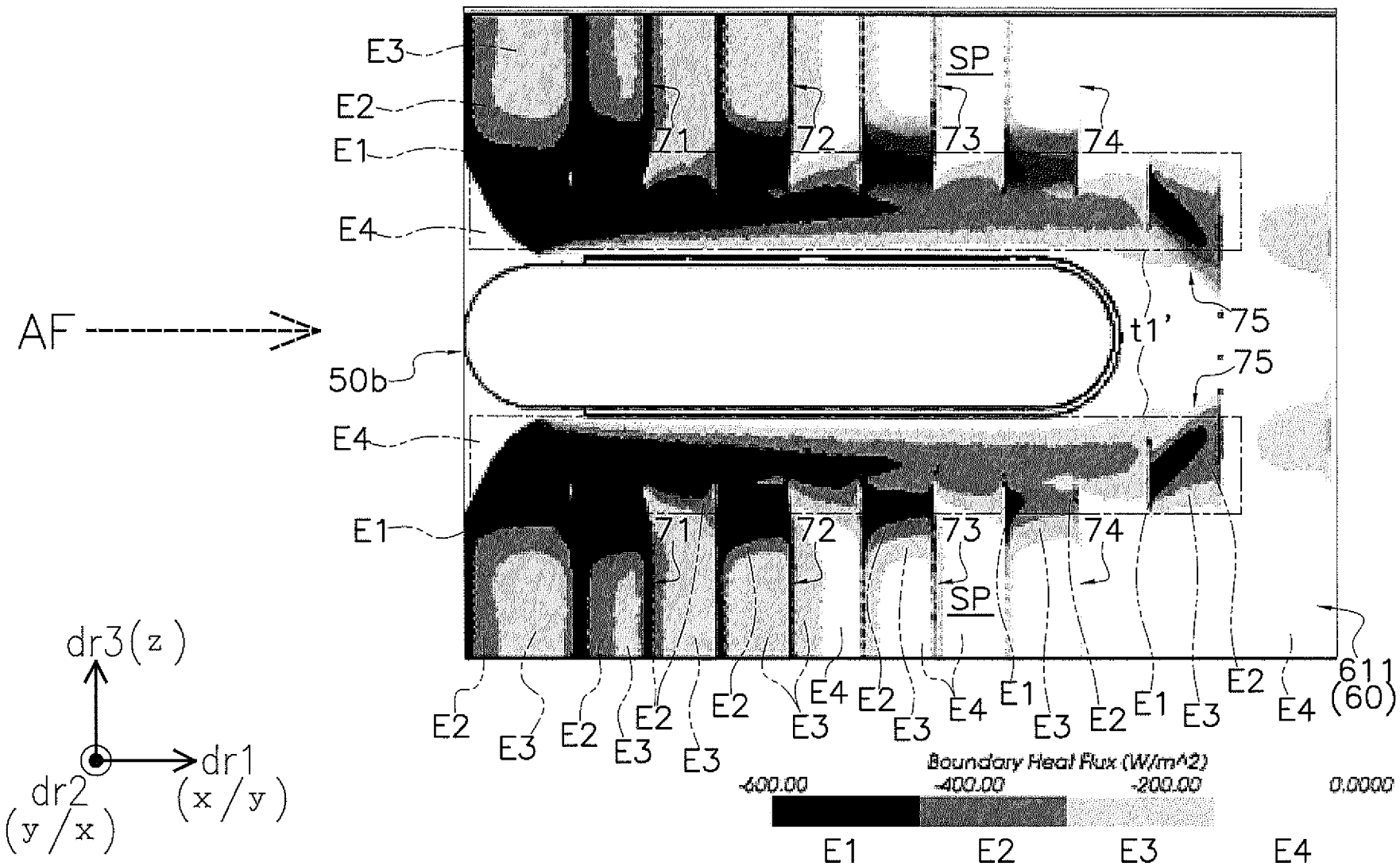
FIG. 9 is a schematic diagram illustrating a comparative example of a degree of the amount of heat transferred in each region in the heat exchange space in a case where the ratio of the protruding area occupying in the reference area in the heat exchange space (formed by leeward side heat transfer tubes) is less than 0.2.
Figure 10:
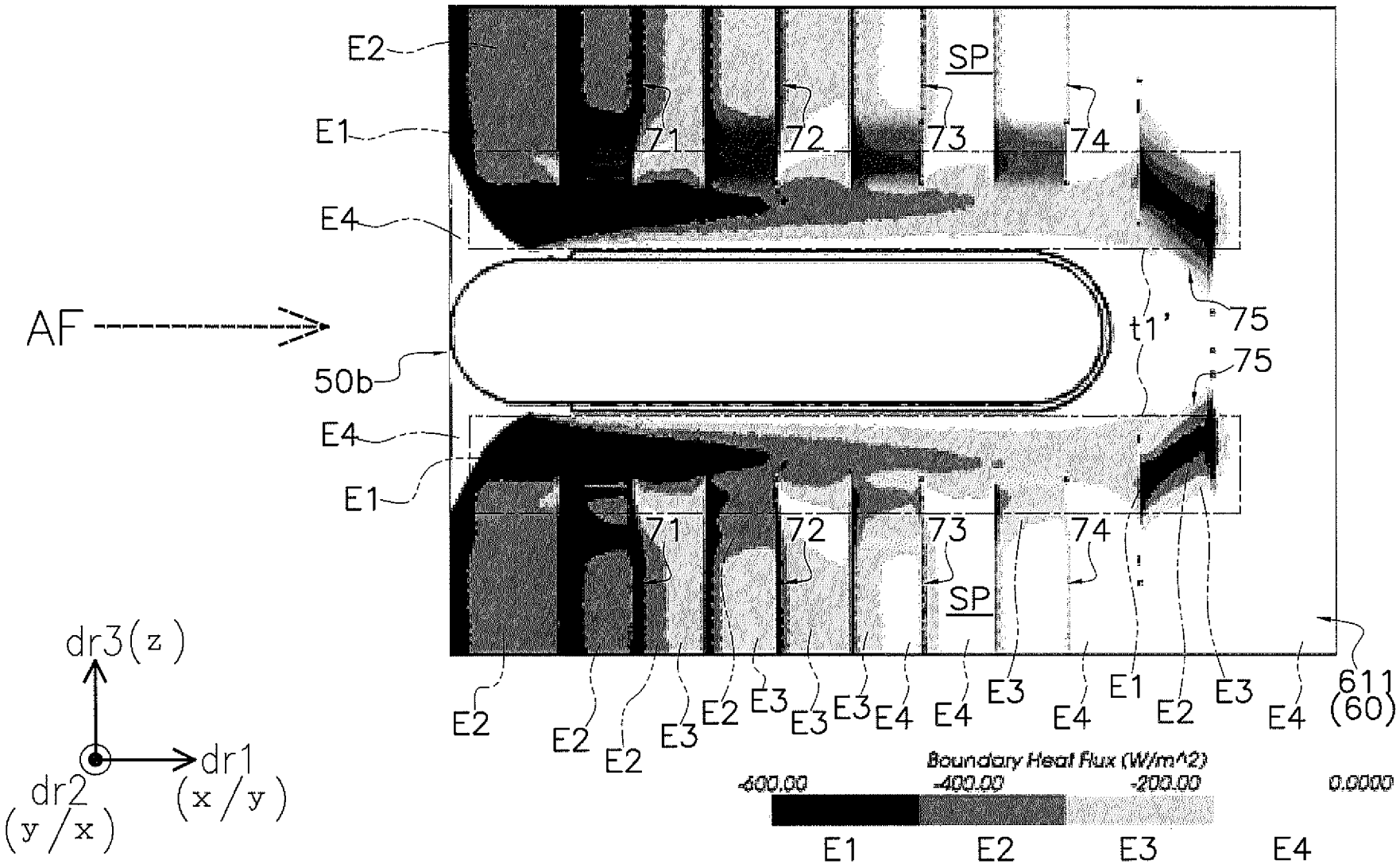
FIG. 10 is a schematic diagram illustrating an example of a degree of the amount of heat transferred in each region in the heat exchange space in a case where the ratio of the protruding area occupying in the reference area in the heat exchange space (formed by leeward side heat transfer tubes) is equal to or greater than 0.2 according to one or more embodiments.

FIG. 9 is a schematic diagram showing an example of a degree of the amount of heat transferred in each region in each of the heat exchange spaces SP in a case where a ratio of the protruding area A1 occupying in the reference area A2 in each of the heat exchange spaces SP (constituted by the leeward side heat transfer tube 50*b*) is less than 0.2. FIG. 10 is a schematic diagram showing an example of the degree of the amount of heat transferred in each region in each of the heat exchange spaces SP in a case where the ratio of the protruding area A1 occupying in the reference area A2 in each of the heat exchange spaces SP (constituted by the leeward side heat transfer tube 50*b*) is equal to or greater than 0.2 (more specifically, equal to or greater than 0.5). In FIG. 9 and FIG. 10, the amount of heat transferred is mainly divided into regions of E1 to E4 according to the degree of the amount of heat transferred and the black concentration (density) is shown more largely in the order of E1>E2>E3>E4, indicating that the degree of the amount of heat transferred is larger.

As shown in FIG. 7, when the ratio of the protruding area A1 occupying in the reference area A2 in each of the heat exchange spaces SP is less than 0.2, the proportion occupied by the portion F1, in which the flow velocity of the air flow AF is high, tends to increase in any of the heat exchange spaces SP located on the windward side and in any of the heat exchange spaces SP located on the leeward side. This is because when the ratio of the protruding area A1 occupying in the reference area A2 in each of the heat exchange spaces SP is less than 0.2, in relation to the fact that a large gap is formed between the fifth protrusion 75 and the main surfaces 52 of the heat transfer tubes 50 (in particular, at a position corresponding to the reference quadrilateral R1) in a state where each of the heat exchange spaces SP is viewed from the air flow direction dr1, the flow velocity of the air flow AF passing through such a gap (more specifically, the gap formed between each of the protrusions 71 to 75 and the main surfaces 52 of the heat transfer tubes 50) is particularly increased (refer to the region t1 indicated by dot-dashed lines in FIG. 7).

That is, when the ratio of the protruding area A1 occupying in the reference area A2 in each of the heat exchange spaces SP is less than 0.2, a drift phenomenon, which causes the flow velocity of the air flow AF to be considerably faster as compared with the other portions, is likely to occur in each of the heat exchange spaces SP. As shown in FIG. 9, when such a drift phenomenon occurs, in each of the heat exchange spaces SP (particularly each of the heat exchange spaces SP at the leeward side), the amount of heat transferred in the portion between each of the protrusions 71 to 75 and the main surfaces 52 of the heat transfer tubes 50 is remarkably larger as compared with those of the other portions (refer to the region t1 indicated by dot-dashed lines in FIG. 9). In other words, a portion having a large amount of heat transferred in each of the heat exchange spaces SP is formed to be partially biased. As a result, in each of the heat exchange spaces SP, the heat exchange between the air flow AF and the refrigerant in the heat transfer tubes 50 is not satisfactorily performed, and the performance of the heat exchanger 21 may decline.

On the other hand, as shown in FIG. 8, when the ratio of the protruding area A1 occupying in the reference area A2 in each of the heat exchange spaces SP is equal to or greater than 0.2, the proportion occupied by the portion F1, in which the flow velocity of the air flow AF is high, is unlikely to increase in any of the exchange spaces SP located on the windward side and in any of the heat exchange spaces SP located on the leeward side. This is because when the ratio of the protruding area A1 occupying in the reference area A2 in each of the heat exchange spaces SP is equal to or greater than 0.2, in relation to suppressing the formation of a large gap between the fifth protrusion 75 and the main surfaces 52 of the heat transfer tubes 50 in a state where each of the heat exchange spaces SP is viewed from the air flow direction dr1, the flow velocity of the air flow AF passing through such a gap (more specifically, the gap formed between each of the protrusions 71 to 75 and the main surfaces 52 of the heat transfer tubes 50) is restrained from being increased (refer to the region t1 indicated by dot-dashed lines in FIG. 8).

That is, when the ratio of the protruding area A1 occupying in the reference area A2 in each of the heat exchange spaces SP is equal to or greater than 0.2, in each of the heat exchange spaces SP, the drift phenomenon, causes a portion where the flow velocity of the air flow AF is considerably faster as compared with that of other portions, is restrained. Therefore, as shown in FIG. 10, the amount of heat transferred is restrained from becoming significantly larger in the portion between each of the protrusions 71 to 75 and the main surfaces 52 of the heat transfer tubes 50 as compared with that of the other portions (refer to the region t1 indicated by dot-dashed lines in FIG. 10).

In other words, in FIG. 10, although the proportion occupied by the region E1 having the largest amount of heat transferred is reduced, the proportion occupied by the region E2 having the next largest amount of heat transferred is increased, and thereby in the entire of the heat exchange space SP, the biased formation of a region having a large amount of heat transferred and a region having a small amount of heat transferred, respectively, is restrained. In other words, as shown in FIG. 10, in each of the heat exchange spaces SP, the proportion occupied by the region E4 having the smallest amount of heat transferred is smaller than in the case of FIG. 9, and the biased formation of a region having a large amount of heat transferred restrained. As a result, the situation where the heat exchange is not performed satisfactorily between the air flow AF and the refrigerant in the heat transfer tubes 50 is restrained.

In addition, when the ratio of the protruding area A1 occupying in the reference area A2 in each of the heat exchange spaces SP is equal to or greater than 0.2, as shown in FIG. 10, the amount of heat transferred at the inclined surface 753 of the fifth protrusion 75 (that is, the amount of heat transferred between the most leeward side protrusion 70 and the air flow) increases, related to restraining the formation of the large gap between the fifth protrusion 75 and the main surfaces 52 of the heat transfer tubes 50 (in particular, restraining the formation of the large gap at a position corresponding to the reference quadrilateral R1) in a state where each of the heat exchange spaces SP is viewed from the air flow direction dr1. As a result, the heat exchange between the air flow AF and the refrigerant in the heat transfer tubes 50 is promoted.

As described above, in the case where the ratio of the protruding area A1 occupying in the reference area A2 in each of the heat exchange spaces SP is equal to or greater than 0.2, the performance degradation of the heat exchanger 21 is restrained.

Figure 11:
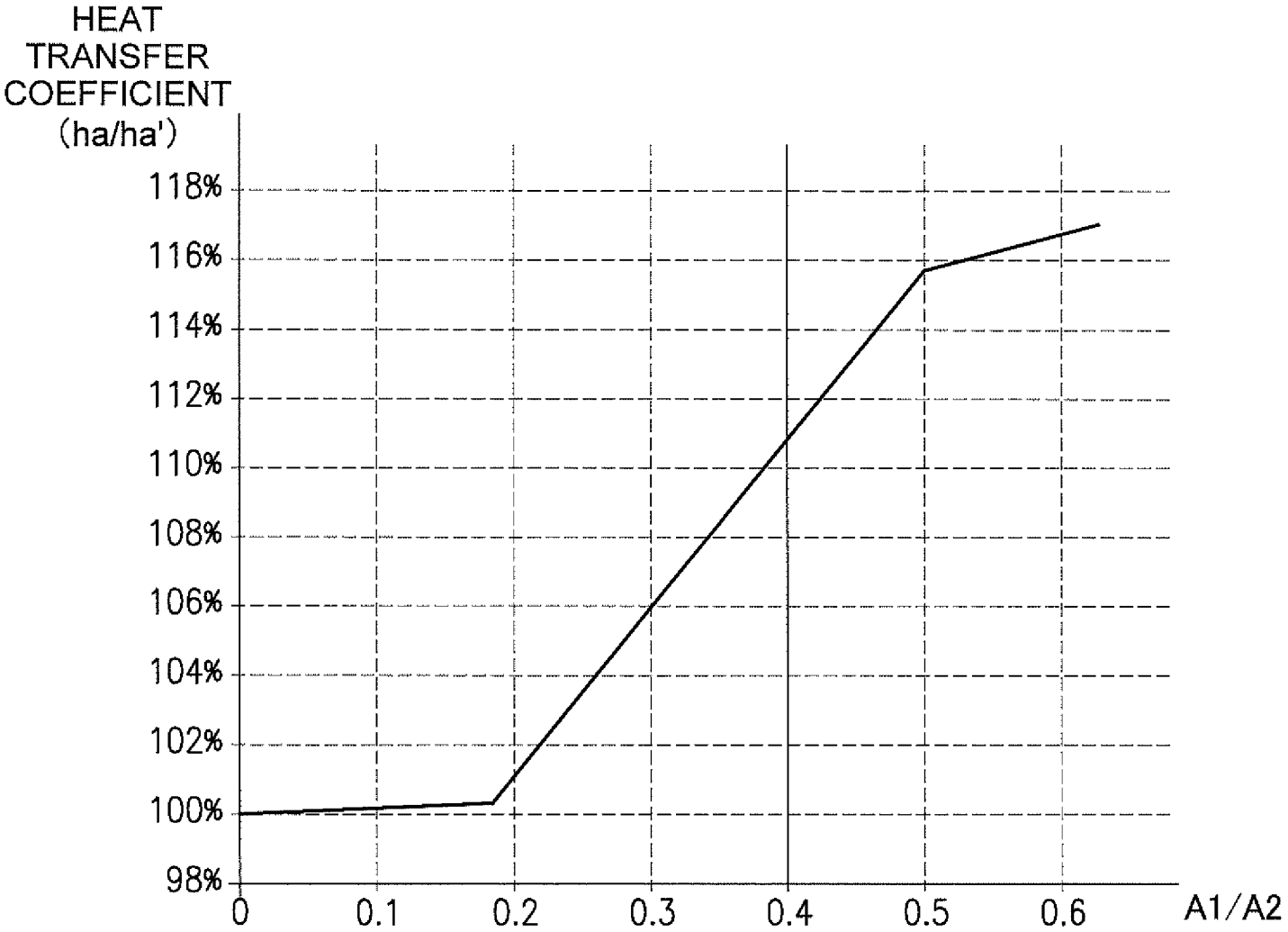
FIG. 11 is a graph showing an example of the correlation between the ratio of the protruding area occupying in the reference area in the heat exchange space and a heat transfer coefficient in the heat exchange space according to one or more embodiments.

FIG. 11 is a graph illustrating an example of the correlation between the ratio of the protruding area A1 occupying in the reference area A2 in each of the heat exchange spaces SP and a heat transfer coefficient in each of the heat exchange spaces SP. As shown in FIG. 11, when the ratio of the protruding area A1 occupying in the reference area A2 in each of the heat exchange spaces SP is less than 0.2, the heat transfer coefficient stagnant at around 100% (namely, heat exchange between the air flow AF and the refrigerant in the heat transfer tubes 50 is not performed satisfactorily). On the other hand, when the ratio of the protruding area A1 occupying in the reference area A2 in each of the heat exchange spaces SP is equal to or greater than 0.2 (particularly, equal to or greater than 0.2 and less than 0.6), the heat transfer coefficient improves dramatically as the ratio increases.

In the heat exchanger 21, the ratio of the protruding area A1 occupying in the reference area A2 in each of the heat exchange spaces SP is configured to be equal to or greater than 0.5 (namely, equal to or greater than 0.2) based on the principle described above. As a result, in the heat exchanger 21, when the air flow AF passes through the heat exchange spaces SP, the drift phenomenon of the air flow AF is restrained to thereby promote the heat exchange between the air flow AF and the refrigerant in the heat transfer tubes 50. Thus, the performance degradation of the heat exchanger 21 is restrained.

(3) Characteristics (3-1)

In the heat exchanger 21 according to one or more embodiments, the heat exchange between the air flow AF and the refrigerant in the heat transfer tubes 50 is facilitated to be appropriately performed, whereby the performance degradation is restrained.

The inventor of the present application has discovered through extensive study that, as in a conventional heat exchanger, regarding the air flow passing through the heat exchange spaces in the heat exchanger where a large gap is formed between the leeward side protrusion and the main surface of the flat tube (heat transfer tube) in each of the heat exchange space when viewed from the air flow direction, the air flow passing through the heat exchange space tends to cause a drift phenomenon in which the flow velocity of the air passing through such a gap becomes significantly higher than the flow velocity of the air passing through the periphery of the protrusions.

Based on this finding, in the heat exchanger 21, according to the air flow directional view v1, the ratio of the area of the fifth protrusion 75 (the other-side-protrusion) occupying in the reference area A2 in each of the heat exchange spaces SP is configured to be equal to or greater than 0.2 (in the air flow directional view v1, the reference area A2 is the area of the reference quadrilateral R1 having the first side L1 and the second side L2, the first side L1 is defined as the length dimensions of the portion, which is located between the edges 70*a* of the one-end-side-protrusions 80 in the fin front side surface 611 where the one-end-side-protrusions 80 (the one-side-protrusion) protrude and the main surfaces 52 of the heat transfer tubes 50 closest to the relevant edge 70*a* of the one-end-side-protrusions 80, and the second side L2 is defined as the length dimensions of the fin pitch P1).

This configuration restrains the formation of the large gap between the fifth protrusion 75 and the main surfaces 52 of the heat transfer tubes 50 (particularly, the formation of the large gap at a position corresponding to the reference quadrilateral R1) in each of the heat exchange spaces SP when viewed from the air flow direction dr1. As a result, with respect to the air flow AF passing through each of the heat exchange spaces SP, the drift phenomenon in which the flow velocity of the air flow AF passing through the gap becomes significantly higher as compared with the flow velocity of the air flow AF passing through the periphery of the protrusion 70 is unlikely to occur. In this regard, heat exchange between the air flow AF and the refrigerant in the heat transfer tubes 50 is facilitated to be appropriately performed, and therefore the performance degradation is restrained.

(3-2)

In the heat exchanger 21 according to one or more embodiments, when each of the heat exchange spaces SP is viewed from the heat transfer fin extending direction dr3, the fifth protrusion 75 (the other-side-protrusion) is disposed at a position where the distance D1 between the edge 75*a* of windward side of the fifth protrusion 75 (which is one out of the windward side edge 75*a* and the leeward side edge 75*b*, the edge closer to the heat transfer tubes 50) and the end portion 501 at the leeward side of the heat transfer tubes 50 (which is one out of the windward side end portion and the leeward side end portions of the heat transfer tubes 50, the one that is closer to the fifth protrusion 75) is greater than zero. This configuration makes it easier to increase the size of the fifth protrusion 75.

That is, in the case where the fifth protrusion 75 is configured so that the distance D1 is zero or less (that is, it overlaps) as viewed from the heat transfer fin extending direction dr3, it is difficult to dispose the fifth protrusion 75 such that that the leeward side edge 75*b* thereof overlaps with the heat transfer tubes 50 in the air flow directional view v1. In this regard, it is difficult to increase the size of the fifth protrusion 75 to the extent to which the formation of the large gap between the fifth protrusion 75 and the main surfaces 52 of the heat transfer tubes 50 is restrained when each of the heat exchange space SP is viewed from the air flow direction dr1.

In this respect, in the heat exchanger 21, by arranging the fifth protrusion 75, when viewed from the heat transfer fin extending direction dr3, at a position where the distance D1 is greater than zero between the edge 75*a* of windward side of the fifth protrusion 75 and the end portions 501 at leeward side of the heat transfer tubes 50, it is facilitated that the provision of the fifth protrusion 75 so that the leeward side edge 75*b* thereof overlaps with the heat transfer tubes 50 in the air flow directional view v1. Therefore, it is easy to make the fifth protrusion 75 larger to the extent that the large gap is unlikely to be formed largely between the fifth protrusion 75 and the main surfaces 52 of the heat transfer tubes 50 when each of the heat exchange spaces SP is viewed from the air flow direction dr1. That is, the ratio of the area of the fifth protrusion 75 occupying in the reference area A2 can be easily set to equal to or greater than 0.2.

(3-3)

In the heat exchanger 21 according to one or more embodiments, in the air flow directional view v1, the length dimension H2 at which the fifth protrusion 75 (the other-side-protrusion) protrudes from the fin front side surface 611 is greater than or equal to the length dimension H1 at which the one-end-side-protrusions 80 (the one-side-protrusion) protrude from the fin front side surface 611. Thereby, configuring the fifth protrusion 75 to be larger is facilitated. That is, the ratio of the area of the fifth protrusion 75 occupying in the reference area A2 can be easily set to equal to or greater than 0.2.

(3-4)

In the heat exchanger 21 according to one or more embodiments, the fifth protrusion 75 (the other-side-protrusion) is disposed at the most leeward side of the plurality of protrusions 70. Thereby, configuring the fifth protrusion 75 to be larger is facilitated. That is, the ratio of the area of the fifth protrusion 75 occupying in the reference area A2 can be easily set to equal to or greater than 0.2.

(3-5)

In the heat exchanger 21 according to one or more embodiments, the ratio of the area of the fifth protrusion 75 (the other-side-protrusion) occupying in the reference area A2 is equal to or greater than 0.5. Accordingly, when viewed from the air flow direction dr1, in each of the heat exchange spaces SP, the formation of the large gap between the fifth protrusion 75 and the main surfaces 52 of the heat transfer tubes 50 is particularly restrained. As a result, with respect to the air flow AF passing through each of the heat exchange spaces SP, particularly, the drift phenomenon in which the flow velocity of the air flow AF passing through such a gap becomes significantly higher as compared with the flow velocity of the air flow AF passing through the periphery of the protrusion 70 is unlikely to occur.

(4) Modifications

The above embodiments can be appropriately modified as described in the following modified examples. It should be noted that each modification may be combined with the other modifications and applied to the extent that no incompatibilities arise.

(4-1) Modification A

In one or more embodiments, in each of the heat exchange spaces SP, the protrusions formed from the windward side to the leeward side in the air flow direction dr1 in the order of the first protrusion 71, the second protrusion 72, the third protrusion 73, the fourth protrusion 74, and the fifth protrusion 75 are provided as the protrusion 70. That is, the fifth protrusion 75 (the other-side-protrusion) is disposed at the most leeward side in each of the heat exchange spaces SP. However, the arrangement position of the fifth protrusion 75 is not necessarily limited to this aspect and may be appropriately changed.

For example, in each of the heat exchange spaces SP, the fifth protrusion 75 may be disposed further to the windward side in the air flow direction dr1 than any one of the protrusions constituting as the one-end-side-protrusion 80 (the other-side-protrusion) out of the first protrusion 71, the second protrusion 72, the third protrusion 73, and the fourth protrusion 74.

Furthermore, among the protrusion 70, the fifth protrusion 75 may be disposed at the most windward side in the air flow direction dr1 in each of the heat exchange spaces SP, for example. In such a case, the fifth protrusion 75 corresponds to the "windward side protrusion" described in the claims, and each of the one-end-side-protrusions 80 corresponds to the "leeward side protrusion" described in the claims.

Figure 12:
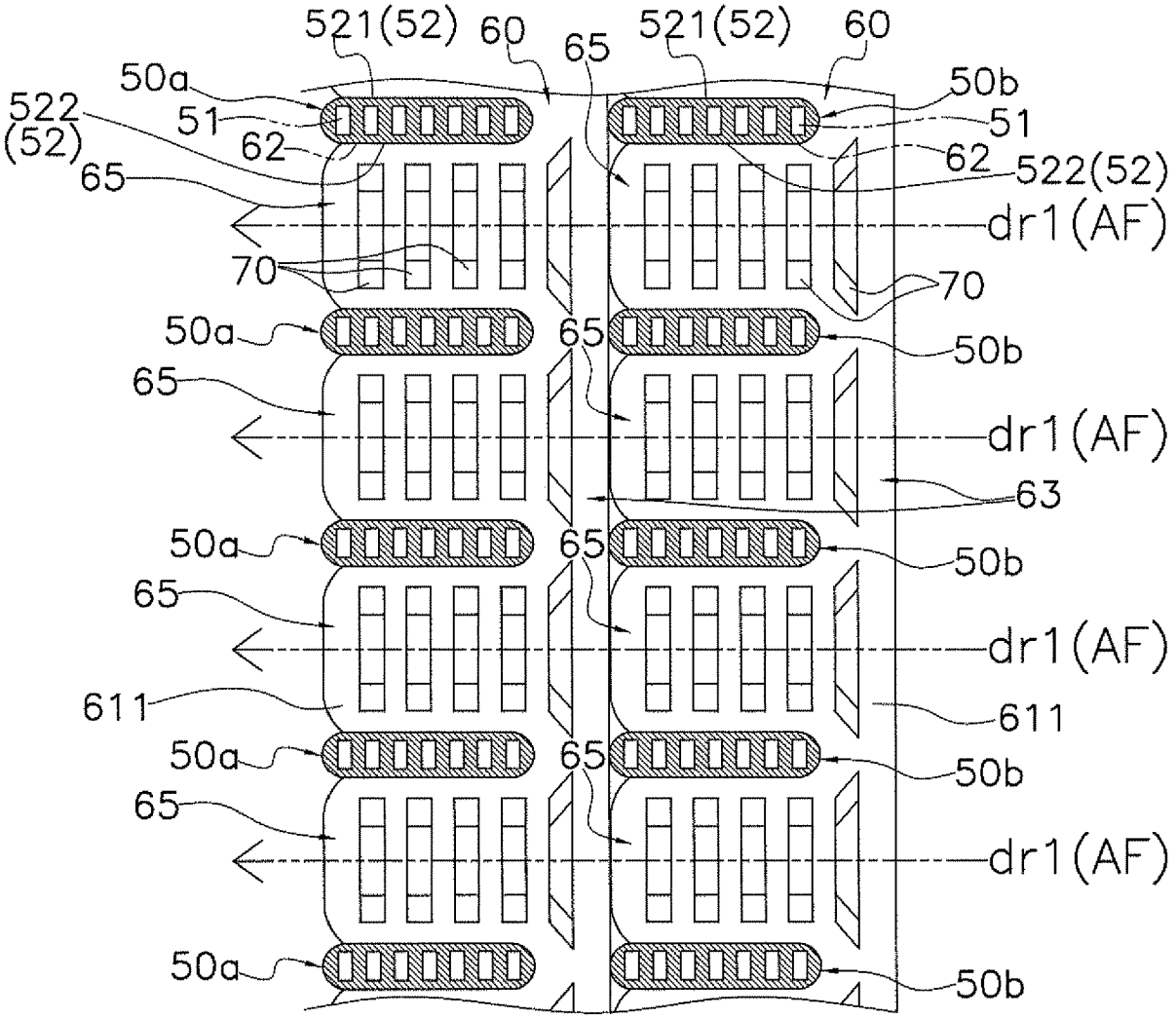
FIG. 12 is a schematic diagram illustrating a state of the heat exchange unit as viewed from an air flow direction in a case where the air flow direction is reversed according to one or more embodiments.
Figure 12:
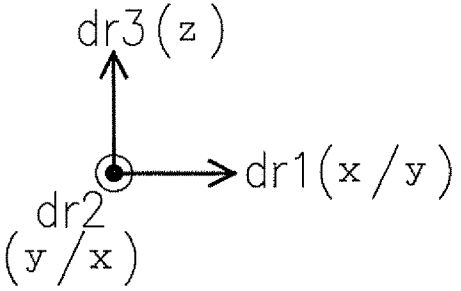
Figure 13:
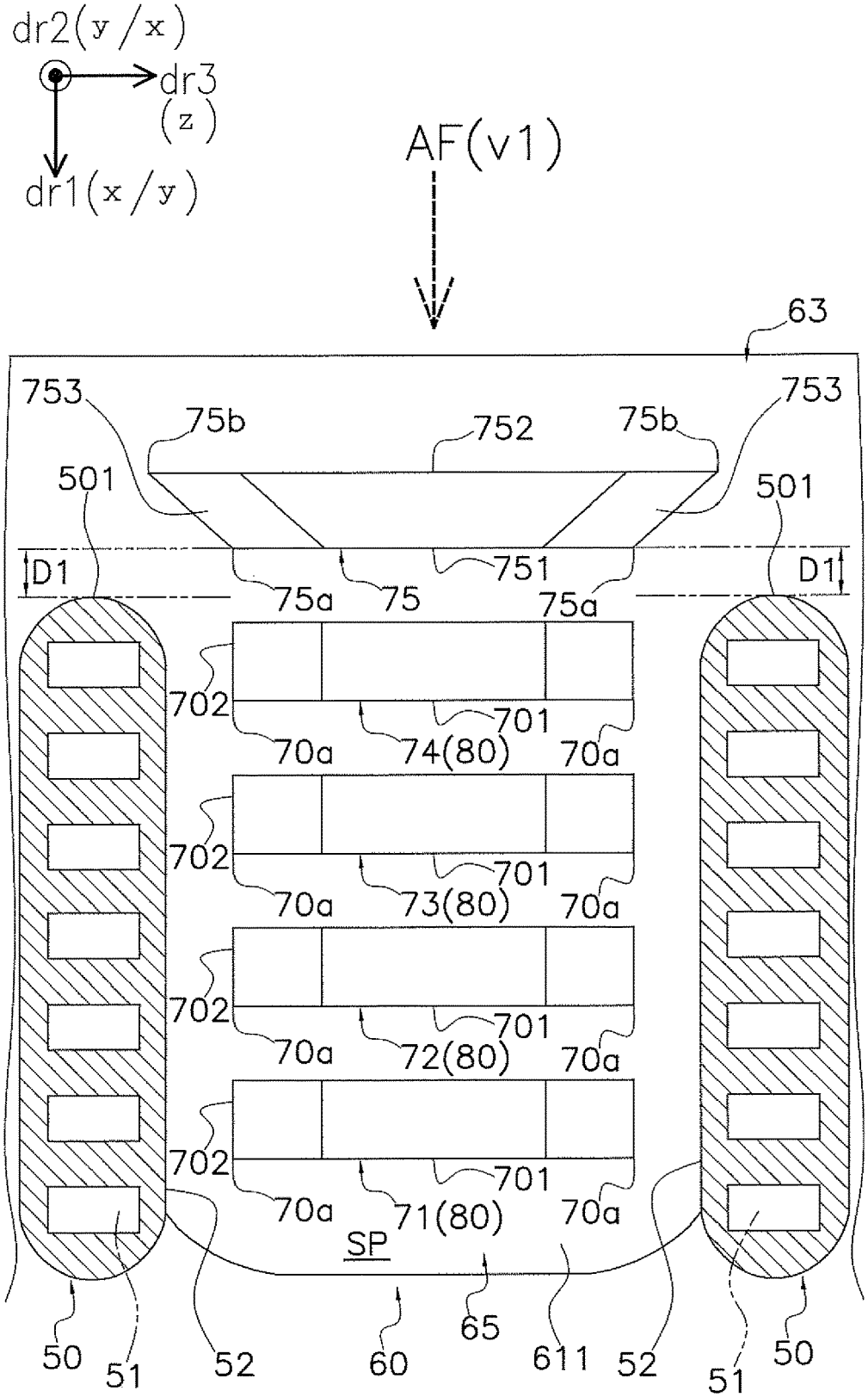
FIG. 13 is a schematic diagram schematically showing a state of the heat exchange space as viewed from the heat transfer tube extending direction in a case where the air flow direction is reversed according to one or more embodiments.

Even in the case where the fifth protrusion 75 is not the protrusion 70 disposed at the most leeward side in each of the heat exchange spaces SP, a configuration may be adopted in which the ratio of the protruding area A1 (the area of the fifth protrusion 75) occupying the reference area A2 in each of the heat exchange spaces SP is equal to or greater than 0.2 (in the air flow directional view v1, the reference area A2 is the area of the reference quadrilateral R1 having the first side L1 and the second side L2, the first side L1 is defined as the length dimensions of the portion, which is located between the edges 70*a* of the one-end-side-protrusions 80 in the fin front side surface 611 where the one-end-side-protrusions 80 protrude (the one-side-protrusion) and the main surfaces 52 of the heat transfer tubes 50 closest to the relevant edge 70*a* of the one-end-side-protrusions 80, and the second side L2 is defined as the length dimensions of the fin pitch P1). For example, as shown in FIG. 12 and FIG. 13, even in a case where the heat exchanger 21 is installed so that the air flow direction dr1 through which the air flow AF flows is opposite to that in one or more embodiments, it is possible to configure the ratio of the protruding area A1 occupying the reference area A2 to equal to or greater than 0.2.

Therefore, even in the case where the fifth protrusion 75 is configured and arranged in such a manner, the same operational effect as the above embodiments may be realized.

(4-2) Modification B

In one or more embodiments, in each of the heat exchange spaces SP, the fifth protrusion 75 (the other-side-protrusion) is disposed, when each of the heat exchange spaces SP is viewed from the heat transfer fin extending direction dr3, at a position where the distance D1 between the edge 75*a* of the windward side thereof and the end portions 501 at the most leeward side of the heat transfer tubes 50 (out of the windward side end portion and leeward side end portions of the heat transfer tubes 50, the ones that are closer to the fifth protrusion 75) is greater than zero. From the viewpoint of adopting a configuration in which the fifth protrusion 75, when each respective heat exchange space SP is viewed from the air flow direction dr1, is formed large to the extent that the large gap is restrained to be formed largely between the fifth protrusion 75 and the main surfaces 52 of the heat transfer tubes 50, it is in one or more embodiments that the fifth protrusion 75 is disposed in such a manner. However, in order to realize the operational effect described in the above (6-1), the fifth protrusion 75 is not necessarily required to be disposed in such a manner.

For example, in each of the heat exchange spaces SP, the fifth protrusion 75 may be disposed at a position where the distance D1 is zero or less when viewed from the heat transfer fin extending direction dr3 (that is, the fifth protrusion 75 may be disposed so that the edge 75*a* of the windward side thereof is positioned further windward than the end portions 501 of the heat transfer tubes 50). Note that in one or more embodiments, the fifth protrusion 75 is configured large (that is, the ratio of the area of the fifth protrusion 75 occupying the reference area A2 is equal to or greater than 0.2) and is disposed such that the edge 75*b* of the leeward side thereof is located further leeward than the end portions 501 of the heat transfer tubes 50.

Also, in one or more embodiments when the fifth protrusion 75 is disposed further to the windward side than the one-end-side-protrusion 80, from the same viewpoint, when each of the heat exchange spaces SP is viewed from the heat transfer fin extending direction dr3, the fifth protrusion 75 in each of the heat exchange spaces SP is disposed at a position where the distance D1 between the edge 75*a* of the leeward side thereof and the end portions 501 at the most windward side of the heat transfer tubes 50 (out of the windward side end portion and leeward side end portions of the heat transfer tubes 50, the one that is closer to the fifth protrusion 75) is greater than zero. However, in order to realize the operational effect described in the above (6-1), the fifth protrusion 75 is not necessarily required to be disposed in such a manner.

That is, in each of the heat exchange spaces SP, the fifth protrusion 75 may be disposed at a position where the distance D1 is zero or less when viewed from the heat transfer fin extending direction dr3 (that is, the fifth protrusion 75 may be disposed such that the edge 75*a* of the leeward side thereof is positioned further to the leeward side than the end portions 501 at the windward side of the heat transfer tubes 50). In one or more embodiments, the fifth protrusion 75 is configured large (that is, the ratio of the area of the fifth protrusion 75 occupying the reference area A2 is equal to or greater than 0.2) and disposed such that the edge 75*b* thereof at the windward side is located further windward than the end portions 501 of the heat transfer tubes 50.

(4-3) Modification C

In one or more embodiments, according to the air flow directional view v1, the ratio of the area of the fifth protrusion 75 (the other-side-protrusion) occupying the reference area A2 in each of the heat exchange spaces SP is configured to equal to or greater than 0.5 (the reference area A2 is, in the air flow directional view v1, the area of the reference quadrilateral R1 having the first side L1 and the second side L2, the first side L1 is defined as the length dimensions of the portion, which is located between the edges 70*a* of the one-end-side-protrusions 80 (the one-side-protrusion) of the fin front side surface 611 and the main surfaces 52 of the heat transfer tubes 50 closest to the relevant edge 70*a* of the one-end-side-protrusions 80, the second side L2 is defined as the length dimensions of the fin pitch P1). According to the viewpoint of restraining the drift phenomenon in each of the heat exchange spaces SP and promoting the heat exchange, in one or more embodiments the ratio is equal to or greater than 0.5 as shown in FIG. 11.

However, the heat exchanger 21 is not necessarily configured such that the ratio is equal to or greater than 0.5; the value of such ratio may be appropriately changed. That is, when it is problematic to set the ratio to equal to or greater than 0.5 due to design restrictions or the like, such ratio may be appropriately selected within the range of $0.2 \leq 0.5$.

That is, as shown in FIG. 11, when the ratio of the protruding area A1 occupying in the reference area A2 in each of the heat exchange spaces SP is less than 0.2, the heat transfer coefficient is stagnant around 100% whereas when the ratio is equal to or greater than 0.2, the heat transfer coefficient improves dramatically as the ratio increases. Therefore, this fact indicates that it is not always necessary that the ratio is equal to or greater than 0.5 in order to realize the effect of one or more embodiments of the present invention, and the ratio can be appropriately changed within the range of $0.2 \leq 0.5$ (4-4) Modification D In one or more embodiments, the length dimension S1 of the long side 701 and that of the short side 702 of each of the one-end-side-protrusions 80 (the first protrusion 71, the second protrusion 72, the third protrusion 73, and the fourth protrusion 74) are configured to be substantially the same. However, the length dimension S1 of the long side 701 and/or the length dimension of the short side 702 of any or all the first protrusion 71, the second protrusion 72, the third protrusion 73, and the fourth protrusion 74 are not necessarily configured to be substantially the same due to the relationship with the other one-end-side-protrusions 80. In one or more embodiments, in each of the heat exchange spaces SP, the first side L1 of the reference quadrilateral R1 is set to the length dimension of a portion (the portion corresponding to "61*a*" in FIG. 6) located in the fin front side surface 611 between the edges 70*a* of the one-end-side-protrusions 80 having the largest length dimension S1 of the long side 701 and the main surfaces 52 of the heat transfer tubes 50 closest to the relevant edge 70*a*.

(4-5) Modification E

In one or more embodiments, each of the protrusions 70 is configured to take a trapezoidal shape according to the air flow directional view v1. However, the configuration of each protrusion 70 can be appropriately changed. For example, each of the protrusions 70 may be configured to exhibit a quadrilateral shape or a pentagonal shape in the air flow directional view v1.

Figure 14:
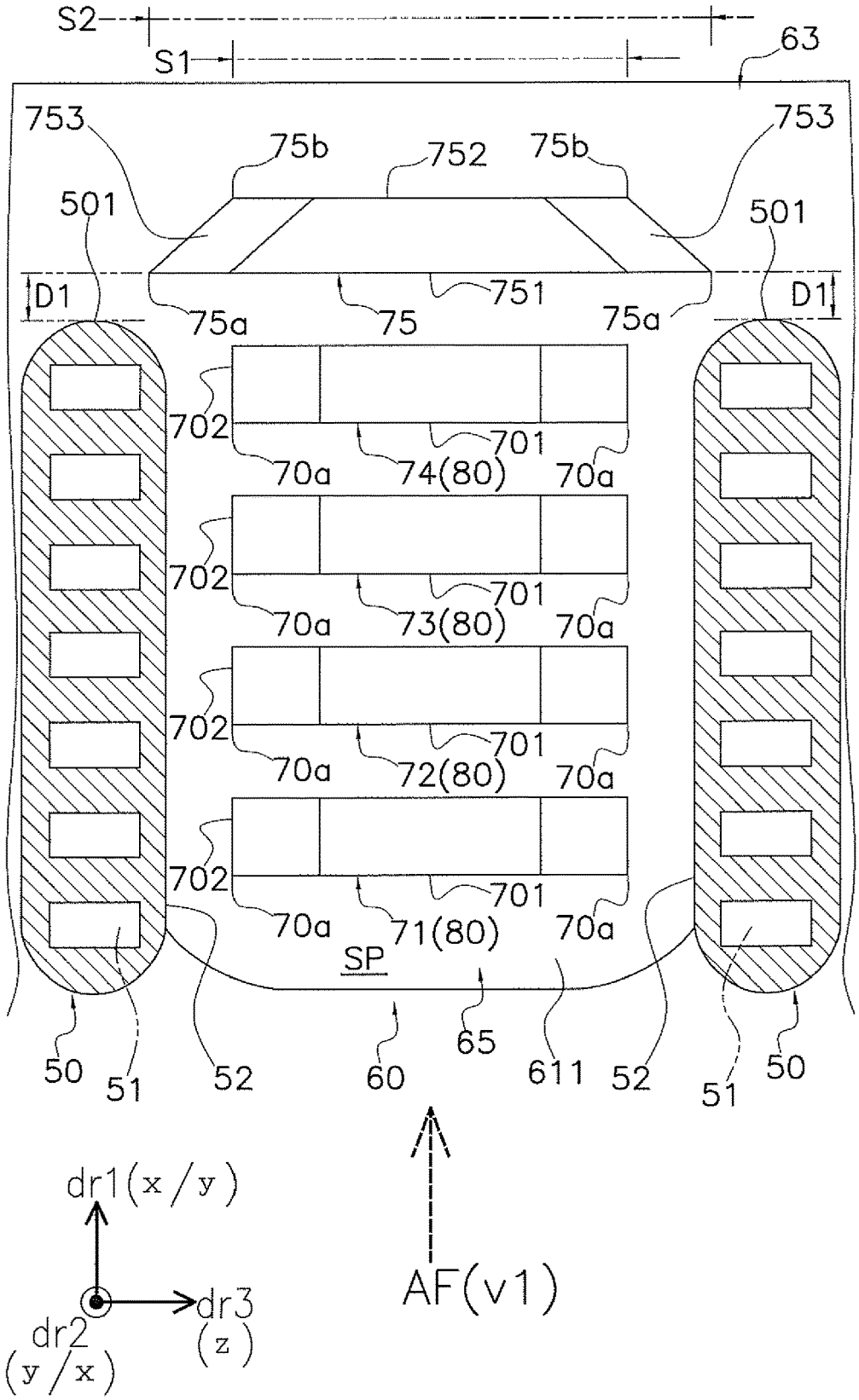
FIG. 14 is a schematic diagram schematically illustrating a state of the heat exchange space as viewed from the heat transfer tube extending direction in a case where a fifth protrusion is provided in a mode according to Modification E according to one or more embodiments.

In addition, for example, as shown in FIG. 14, when viewed from the heat transfer tube extending direction dr2, the fifth protrusion 75 may be configured to take a trapezoidal shape in which the upper side 751 (a side on the windward side) is longer than the lower side 752 (a side on the leeward side). That is, a configuration may be adopted in which the leeward side edges 75*b* (the edge at both ends of the lower side 752) of the fifth protrusion 75 is located more inward than the windward side edges 75*a* (the edges at both ends of the upper side 751) when viewed from the heat transfer tube extending direction dr2. Even when the fifth protrusion 75 is configured in such a manner, the same operation effect as the above embodiments can be realized.

(4-6) Modification F

In one or more embodiments, each of the protrusions 70 is formed by cutting out the heat transfer fin 60 (heat transfer promoting portion 65). However, each of the protrusions 70 is not necessarily formed by being cut out and raised, but may be configured to protrude along the heat transfer tube extending direction dr2 by another method.

For example, any or all of the protrusions 70 may be configured by causing the fin back side surface 612 to bulge toward the fin front side surface 611 so as to protrude along the heat transfer tube extending direction dr2 (that is, the periphery edge of the protrusion 70 continuously extends and protrudes from the fin front side surface 611).

Further, for example, any or all of the protrusions 70 may be configured to protrude along the heat transfer tube extending direction dr2 by cutting and bending the fin front side surface 611 to form a louver shape.

Further, for example, any or all of the protrusions 70 may be provided by adhering a separate member (a baffle plate or the like) other than the heat transfer fins 60 to the fin front side surface 611.

(4-7) Modification G

In one or more embodiments, as the one-end-side-protrusions 80, four of the protrusions 70 (the first protrusion 71, the second protrusion 72, the third protrusion 73, and the fourth protrusion 74) are provided on the windward side of the fifth protrusion 75. The number and configuration aspects of the one-end-side-protrusions 80 are not particularly limited, and may be appropriately changed according to design specifications.

For example, any one of the first protrusion 71, the second protrusion 72, the third protrusion 73, and the fourth protrusion 74 of the one-end-side-protrusions 80 may be appropriately omitted. In addition, any one of the first protrusion 71, the second protrusion 72, the third protrusion 73, and the fourth protrusion 74 may be combined and configured integrally. Further, for example, in the heat transfer promoting portion 65, another one-end-side-protrusion 80 may be provided at the windward side of the most leeward side protrusion 70 (the fifth protrusion 75) in addition to the first protrusion 71, the second protrusion 72, the third protrusion 73, and the fourth protrusion 74.

(4-8) Modification H

In one or more embodiments, in each of the heat exchange spaces SP, each of the protrusions 70 (protrusions 71 to 75) protrudes from the fin front side surface 611 toward the fin back side surface 612 of another heat transfer fin 60 opposed to the relevant fin front side surface 611 (that is, extends toward the heat transfer tube extending direction dr2). In other words, in one or more embodiments, in each of the heat exchange spaces SP, the protrusions 70 are each configured to protrude in the same direction from the fin front side surface 611.

However, in each of the heat exchange spaces SP, each of the protrusions 70 is not necessarily configured in such a manner. That is, in each of the heat exchange spaces SP, the protrusions 70 (protrusions 71 to 75) may be each configured to protrude in a different direction from the other-side-protrusions 70. In other words, a configuration may be adopted in which in each of the heat exchange spaces SP, any or all of the one-end-side-protrusions 80 (the one-side-protrusion) and the fifth protrusion 75 (the other-side-protrusion) protrude in opposite directions to each other.

Figure 15:
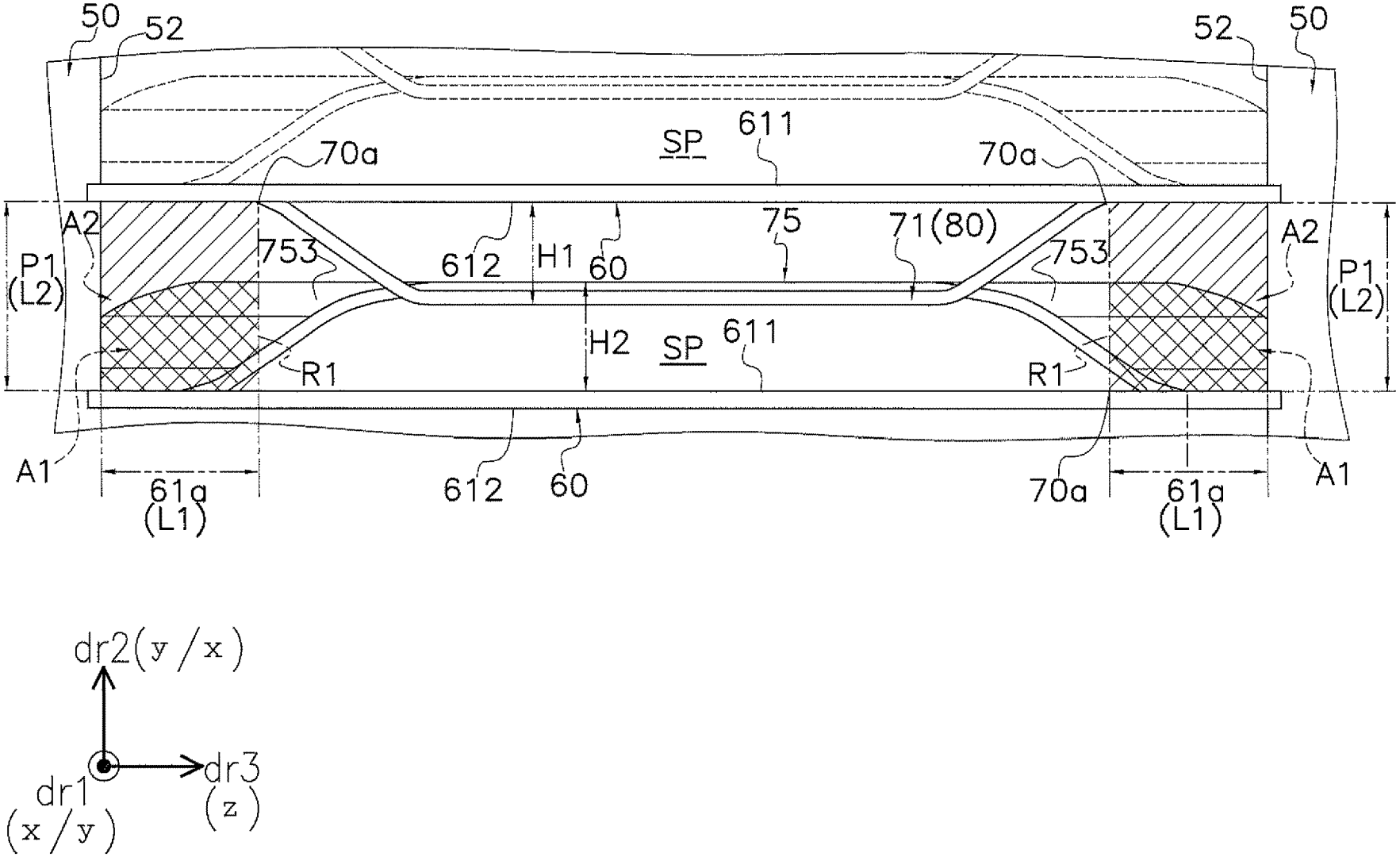
FIG. 15 is a schematic diagram schematically illustrating a state of the heat exchange space as viewed from the air flow direction in a case where each protrusion is provided in a mode according to Modification H according to one or more embodiments.

For example, each of the protrusions 70 may be configured as shown in FIG. 15. In FIG. 15, in each of the heat exchange spaces SP, each of the one-end-side-protrusions 80 is configured to protrude from the fin back side surface 612 toward the fin front side surface 611 of the other heat transfer fin 60 opposed to the relevant fin back side surface 612. Meanwhile, the fifth protrusion 75 is configured to protrude from the fin front side surface 611 toward the fin back side surface 612 of the other heat transfer fin 60 opposed to the relevant fin front side surface 611. That is, in FIG. 15, a configuration is adopted in which the one-end-side-protrusions 80 and the fifth protrusion 75 are configured to protrude in different directions in each of the heat exchange spaces SP. More specifically, in FIG. 15, as to two heat transfer fins that configure each of the heat exchange spaces SP, one of which is the one-end-side-protrusions 80 protrudes from one of the heat transfer fins 60 while the other is the fifth protrusion 75 protrudes from the other heat transfer fin 60 in each of the heat exchange spaces SP. The one-end-side-protrusions 80 and the fifth protrusion 75 protrude in opposite directions so as to intersect with the air flow direction dr1.

Even in the case where each of the protrusions 70 is configured in this manner, in each of the heat exchange spaces SP, the ratio of the protruding area A1 (the area of the fifth protrusion 75) occupying the reference area A2 can be configured to be equal to or greater than 0.2 (in the air flow directional view v1, the reference area A2 is the area of the reference quadrilateral R1 having the first side L1 and the second side L2, the first side L1 is defined as the length dimensions of the portion, which is located between the edges 70*a* of the one-end-side-protrusions 80 in the fin front side surface 611 where the one-end-side-protrusions 80 protrude and the main surfaces 52 of the heat transfer tubes 50 closest to the relevant edges 70*a* of the one-end-side-protrusions 80, and the second side L2 is defined as the length dimensions of the fin pitch P1). Therefore, even in the case where the fifth protrusion 75 is disposed in such a manner, the same operational effect as the above embodiments can be realized.

Note that in contrast to one or more embodiments shown in FIG. 15, the same is applied to for a case where any or all of the one-end-side-protrusions 80 are configured to protrude from the fin front side surface 611 and the fifth protrusion 75 is configured to protrude from the fin back side surface 612 in each of the heat exchange spaces SP.

(4-9) Modification I

Figure 16:
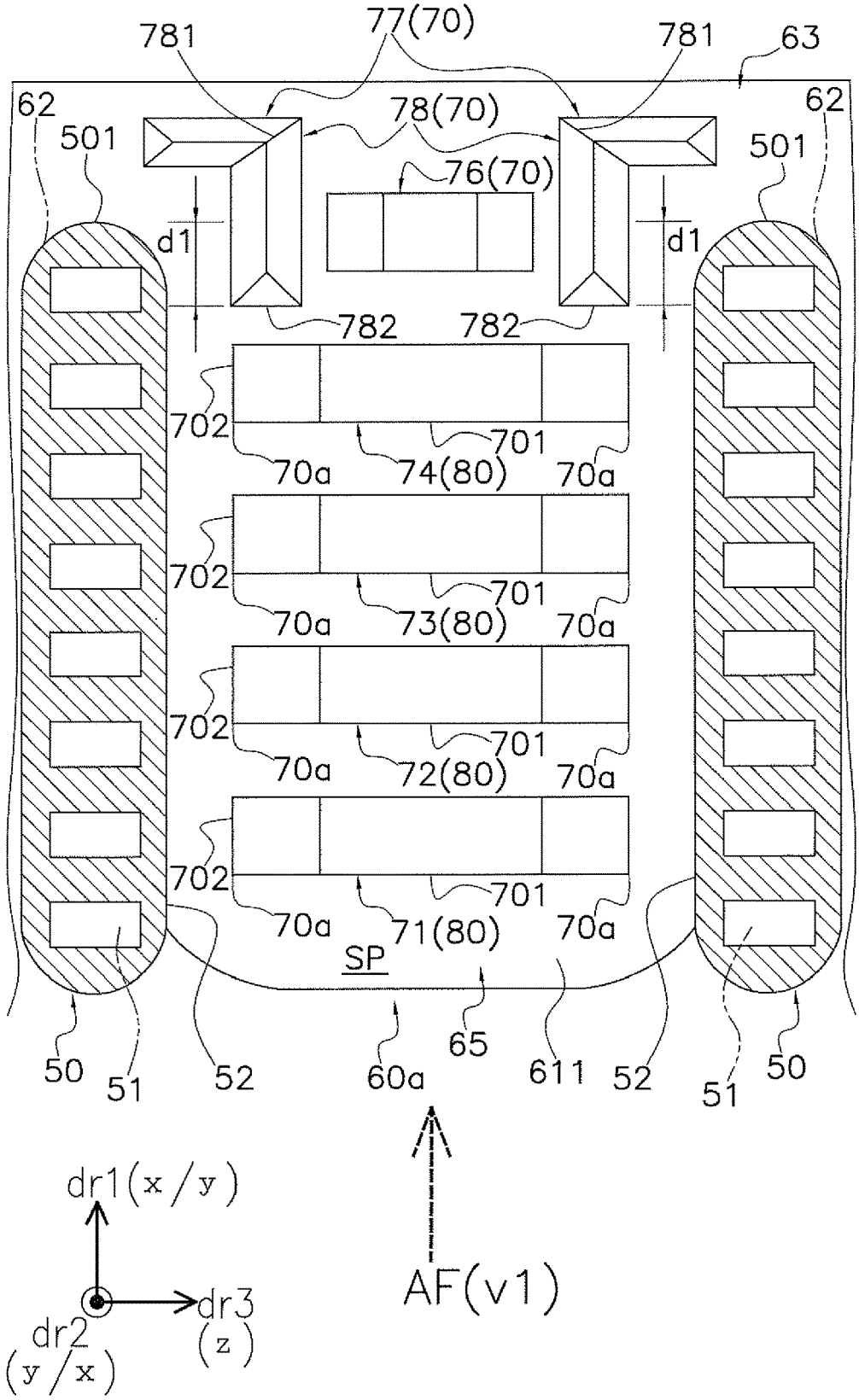
FIG. 16 is a schematic view of the heat exchange space constituted by heat transfer fins according to Modification I as viewed from the heat transfer tube extending direction according to one or more embodiments.
Figure 17:
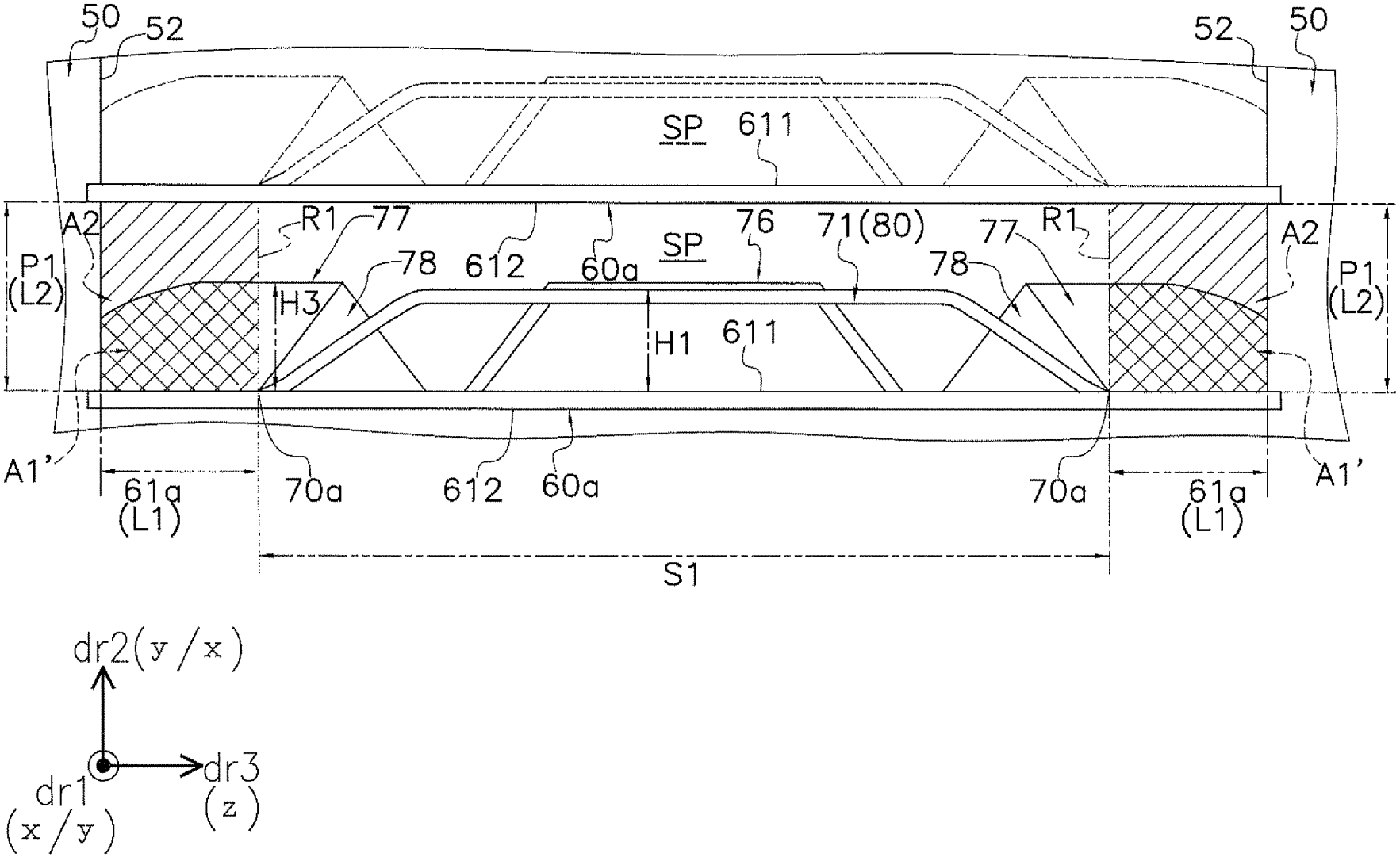
FIG. 17 is a schematic view of FIG. 16 as viewed from the air flow direction.

The heat transfer fin 60 in one or more embodiments may be configured as a heat transfer fin 60*a* as shown in FIG. 16. FIG. 16 is a schematic view of each of the heat exchange spaces SP configured by the heat transfer fin 60*a* as viewed from the heat transfer tube extending direction dr2. FIG. 17 is a schematic view of FIG. 16 as viewed from the air flow direction dr1. It is to be noted that in FIG. 17, a protruding area A' is the area occupied by a seventh protrusion 77 (will be described later) in each of the heat exchange spaces SP in the air flow directional view v1.

In the heat transfer fin 60*a*, the one-end-side-protrusions 80 (protrusions 71 to 74) are provided in the heat transfer promoting portion 65 similarly to the heat transfer fin 60. On the other hand, in the heat transfer fin 60*a*, instead of the fifth protrusion 75, a sixth protrusion 76, a plurality of seventh protrusions 77 (in this case, two), and a plurality of eighth protrusions 78 (in this case, two) are provided for each heat transfer promoting portion 65.

The sixth protrusion 76 is cut and raised from the fin front side surface 611 along the heat transfer tube extending direction dr2 on the leeward side of the one-end-side-protrusions 80 in the same manner as the fifth protrusion 75. The sixth protrusion 76 exhibits a substantially rectangular shape when viewed from the heat transfer tube extending direction dr2 (refer to FIG. 16) and exhibits a substantially trapezoidal shape according to the air flow directional view v1 (refer to FIG. 17).

Unlike the fifth protrusion 75, the size of the sixth protrusion 76 is smaller than each of the one-end-side-protrusions 80 when viewed from the heat transfer tube extending direction dr2. Specifically, in the air flow directional view v1, the sixth protrusion 76 has a smaller length dimension along the heat transfer fin extending direction dr3 than each of the one-end-side-protrusions 80. Therefore, the width of the sixth protrusion 76 is smaller than the width of each of the one-end-side-protrusions 80 when viewed from the air flow direction dr1 (refer to FIG. 17).

The seventh protrusions 77 (corresponding to the "leeward side protrusion" and the "other-side-protrusion" described in the claims) bulge from the fin front side surface 611 along the heat transfer tube extending direction dr2 on the leeward side further than the one-end-side-protrusions 80 and the sixth protrusion 76. The seventh protrusions 77 each exhibit a substantially trapezoidal shape when viewed from the heat transfer tube extending direction dr2 (refer to FIG. 16), exhibit a substantially triangular shape when viewed from the heat transfer fin extending direction dr3, and according to the air flow directional view v1, exhibit a substantially trapezoidal shape.

When viewed from the heat transfer tube extending direction dr2, the size of each of the seventh protrusions 77 is smaller than the size of each of the one-end-side-protrusions 80. That is, in the air flow directional view v1, each of the seventh protrusions 77 has a smaller length dimension in the heat transfer fin extending direction dr3 than those of the one-end-side-protrusions 80. Therefore, the width of the seventh protrusions 77 is smaller than the width of each of the one-end-side-protrusions 80 when viewed from the air flow direction dr1.

The seventh protrusions 77 are located at the most leeward side out of all of the protrusions 70. The seventh protrusions 77 are disposed in the fin main body 63. In the air flow directional view V1, the seventh protrusions 77 are located between the one-end-side-protrusions 80 and the main surface 52 of each of the heat transfer tubes 50. In the heat transfer fin 60*a*, when viewed from the heat transfer tube extending direction dr2, a pair of seventh protrusions 77, with the sixth protrusion 76 therebetween, is disposed so as to extend along the heat transfer fin extending direction dr3 toward a direction further outward than the edges 70*a* of the one-end-side-protrusions 80 in each of the heat exchange spaces SP.

A length dimension H3 (refer to FIG. 17) by which the seventh protrusions 77 protrude toward the heat transfer tube extending direction dr2 is larger than the length dimension H1. That is, the seventh protrusions 77 bulge from the fin front side surface 611 along the heat transfer tube extending direction dr2 so that the protruding length dimension (H3) is larger as compared to each of the one-end-side-protrusions 80.

The disposition of the seventh protrusions 77 of one or more embodiments reduces the gap between the one-end-side-protrusions 80 and the main surfaces 52 of the respective heat transfer tubes 50 in the air flow directional view v1. Specifically, the ratio of the protruding area A1' (the area of the seventh protrusions 77) occupying in the reference area A2 in each of the heat exchange spaces SP in the air flow directional view v1 is equal to or greater than 0.2 (more specifically, 0.5).

The eighth protrusions 78 (corresponding to the "strength enhancement protrusion" described in the claims) increase the strength of the heat transfer fin 60*a*. Each of the eighth protrusions 78 bulges, at a position of the leeward side than the one-end-side-protrusion 80, from the fin front side surface 611 along the heat transfer tube extending direction dr2. The eighth protrusions 78 are disposed between the one-end-side-protrusions 80 and the seventh protrusions 77 as viewed from the heat transfer tube extending direction dr2. Most of the eighth protrusions 78 is located further to the windward side than the seventh protrusions 77.

Each of the eighth protrusions 78 exhibits a substantially trapezoidal shape when viewed from the heat transfer tube extending direction dr2 (refer to FIG. 16). Each of the eighth protrusions 78 exhibits a substantially triangular shape according to the air flow directional view v1. In the air flow directional view v1, a length dimension of the respective eighth protrusions 78 in the heat transfer fin extending direction dr3 is smaller than that of each of the one-end-side-protrusions 80. Therefore, the widths of the eighth protrusions 78 are smaller than the width of each of the one-end-side-protrusions 80 when viewed from the air flow direction dr1.

Each of the eighth protrusions 78 extends, on the leeward side of the one-end-side-protrusions 80, from one end side of the heat transfer fin 60*a* towards the other end side thereof in the air flow direction dr1. The eighth protrusions 78 are disposed in the fin main body 63. That is, the eighth protrusions 78 extend along the air flow direction dr1 in the fin main body 63.

When viewed from the heat transfer fin extending direction dr3, the eighth protrusions 78 have their terminal ends 782 located further to the windward side (one end side of the heat transfer fin 60*a*) than the slits 62 (that is, the end portions 501 of the heat transfer tubes 50) in the air flow direction dr1. When viewed from the heat transfer fin extending direction dr3, each of the eighth protrusions 78 has their tip end 781 located further to the leeward side (the other end side of the heat transfer fin 60*a*) than the slit 62 (that is, the end portion 501 of the heat transfer tube 50) in the air flow direction dr1. Also, most of the eighth protrusions 78 are located between the one-end-side-protrusions 80 (the one-side-protrusion) and the seventh protrusions 77 (the other-side-protrusion) when viewed from the heat transfer fin extending direction dr3. The eighth protrusions 78 are located on the outer side of the sixth protrusion 76 when viewed from the heat transfer tube extending direction dr2. In the heat transfer fins 60*a*, when viewed from the heat transfer tube extending direction dr2, the pair of eighth protrusions 78 is disposed so as to extend along the air flow direction dr1 toward the leeward direction with the sixth protrusion 76 interposed therebetween in each of the heat exchange spaces SP.

The disposition of the eighth protrusions 78 of one or more embodiments restrains the deformation and buckling of the heat transfer fin 60*a* when a load is applied to the heat transfer fin 60*a* (particularly when a load is applied along the air flow direction dr1 or the opposite direction thereto). More specifically, when the eighth protrusions 78 are not provided, buckling tends to occur at a portion between the edges constituting the slit 62 and the end portions 501 of the heat transfer tubes 50 due to a force applied by a bending processing or the like. In order to improve the buckling strength of such portions, it is conceivable that the heat transfer fin 60*a* is made of a material having a large Young's modulus, or the wall thickness thereof is set to a large second moment of area; however, adopting these approaches leads to increase in cost and decrease in productivity. Therefore, in the heat transfer fin 60*a*, the eighth protrusions 78 are provided in order to improve the buckling strength while not increasing the cost and not decreasing the productivity. As a result, the performance degradation of the heat exchanger 21 due to deformation or buckling of the heat transfer fin 60*a* is restrained.

Particularly, in the heat transfer fin 60*a*, the eighth protrusions 78 are disposed on the fin main body 63, and thereby deformation and buckling of the heat transfer fin 60*a* can be restrained when a load is applied to the fin main body 63 from the side opposite to the side where the heat transfer tubes 50 are inserted (in this case, the leeward side). As a result, even when a load is applied to the fin main body 63 from the side, opposite to the side where the flat tubes is inserted, of the heat transfer fin 60*a*, for example, during the manufacturing process of the heat exchanger, such as bending, or at the time of transportation or the like, deformation and buckling of the heat transfer fin 60*a* is restrained to thereby reduce the performance degradation of heat exchanger 21.

Further, as shown in FIG. 16, when viewed from the heat transfer fin extending direction dr3, portion of each of the eighth protrusions 78 overlaps the heat transfer tubes 50 (the edge portions of the slits 62) and the terminal ends 782 of the eighth protrusions 78 are located on the windward side in the air flow direction dr1 (one end side of the heat transfer fin 60*a*) by a length corresponding to a length d1 rather than to the slits 62 (the end portions 501 of the heat transfer tubes 50). As a result, the above effect is particularly promoted. That is, the buckling strength of the heat transfer fin 60*a* (especially the portions of the edges constituting the slits 62 that face the end portions 501 of the heat transfer tubes 50) increases in accordance with the increase of the length d1. In other words, by disposing the eighth protrusions 78 so as to overlap with the heat transfer tubes 50 when viewed from the heat transfer fin extending direction dr3, the effect of improving the second moment of area of the relevant portion increases, thereby further enhancing the buckling strength of the heat transfer fin 60*a*.

Figure 18:
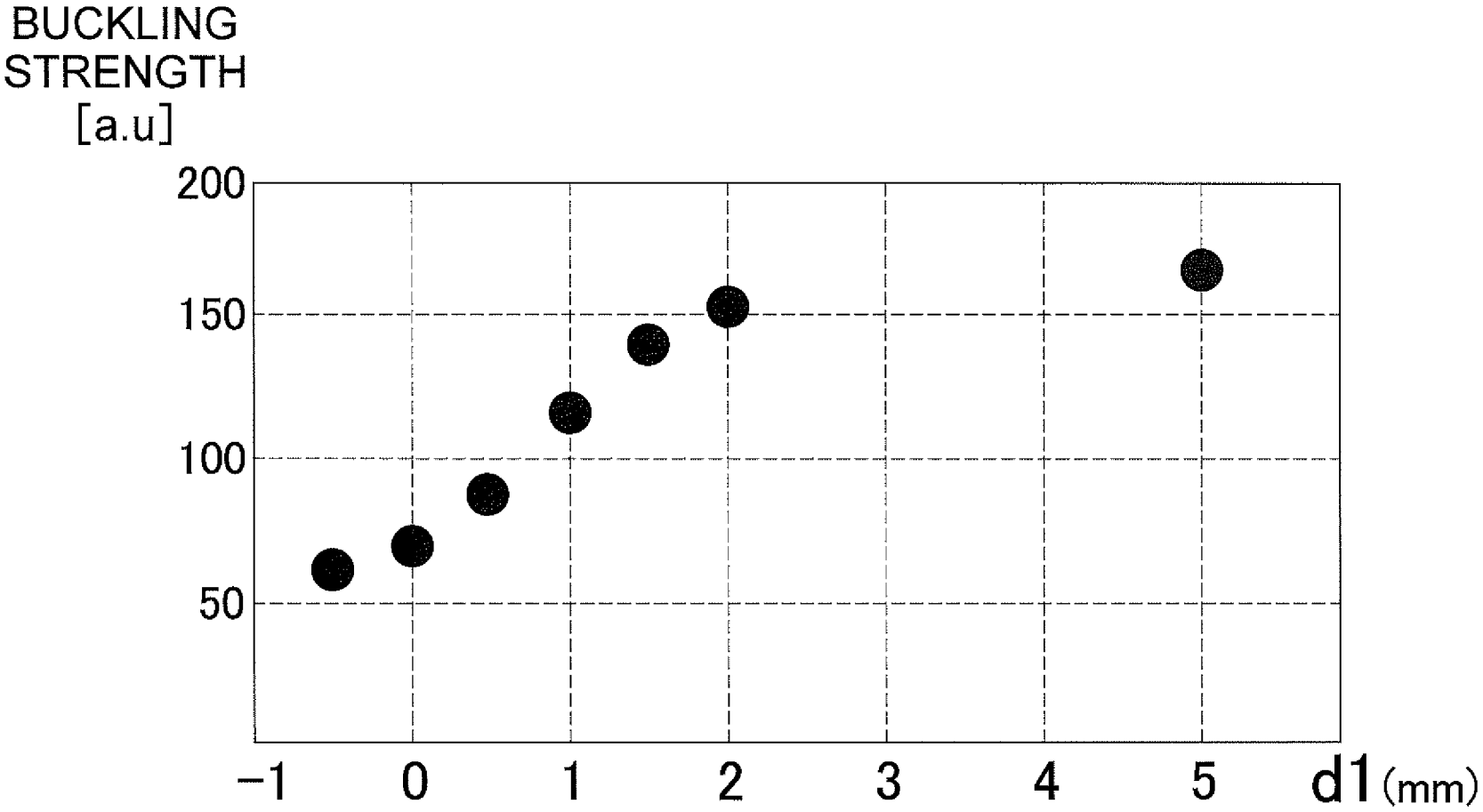
FIG. 18 is a graph schematically showing a relationship between a buckling strength of the heat transfer fin according to Modification I and a length at which an eighth protrusion overlaps with the heat transfer tube when viewed from a heat transfer fin extending direction according to one or more embodiments.

FIG. 18 is a graph schematically showing the relationship between the buckling strength of the heat transfer fin 60*a* and the length d1. As shown in FIG. 18, the buckling strength of the heat transfer fin 60*a* improves in accordance with the increase of the length d1 of the eighth protrusions 78 extending further to the windward side (one end side of the heat transfer fin 60*a*) than the slits 62 (the end portions 501 of the heat transfer tubes 50) as viewed from the heat transfer fin extending direction dr3. Particularly, the graph of FIG. 18 shows that the buckling strength of the heat transfer fin 60*a* in the case where the length d1 is ensured at 1 mm or more improves equal to or more than twice as compared with the case where the length d1 is 0 mm with respect to the eighth protrusions 78. Based on such data, the heat transfer fin 60*a* is provided so that the length d1 is ensured to be large with respect to the eighth protrusions 78.

Further, since the eighth protrusions 78 are disposed in the space formed between the one-end-side-protrusions 80 and the seventh protrusions 77 (the other-side-protrusions) in the heat transfer fin 60*a*, in the narrow respective heat exchange space SP, the eighth protrusions 78 for enhancing the strength can coexist with the one-end-side-protrusions 80 and the seventh protrusions 77 for reducing air drift.

Further, in the heat transfer fin 60*a*, each of the eighth protrusions 78 is formed integrally with the seventh protrusion 77 (the other-side-protrusions). When viewed from the heat transfer tube extending direction dr2, the tip end 781 (an end portion on the leeward side) of each of the eighth protrusions 78 is connected to the seventh protrusion 77. This configuration in which the eighth protrusions 78 are respectively formed integrally with the seventh protrusions 77 (the other-side-protrusions) allows the eighth protrusions 78 for enhancing the strength and the seventh protrusions 77 (the other-side-protrusion) for reducing the air drift to coexist in the narrow respective heat exchange space SP.

Also, in the case where the heat exchanger 21 is provided with the heat transfer fin 60*a*, it is possible to achieve the same operational effect as that of the above embodiments. Here, the heat transfer promoting function in a case where the heat exchanger 21 is provided with the heat transfer fin 60*a* will be described with reference to FIG. 19 and FIG. 20. Note that the analysis results and data shown in FIG. 19 to FIG. 20 are those that have been clarified by the inventor of the present invention after extensive studies.

Figure 19:
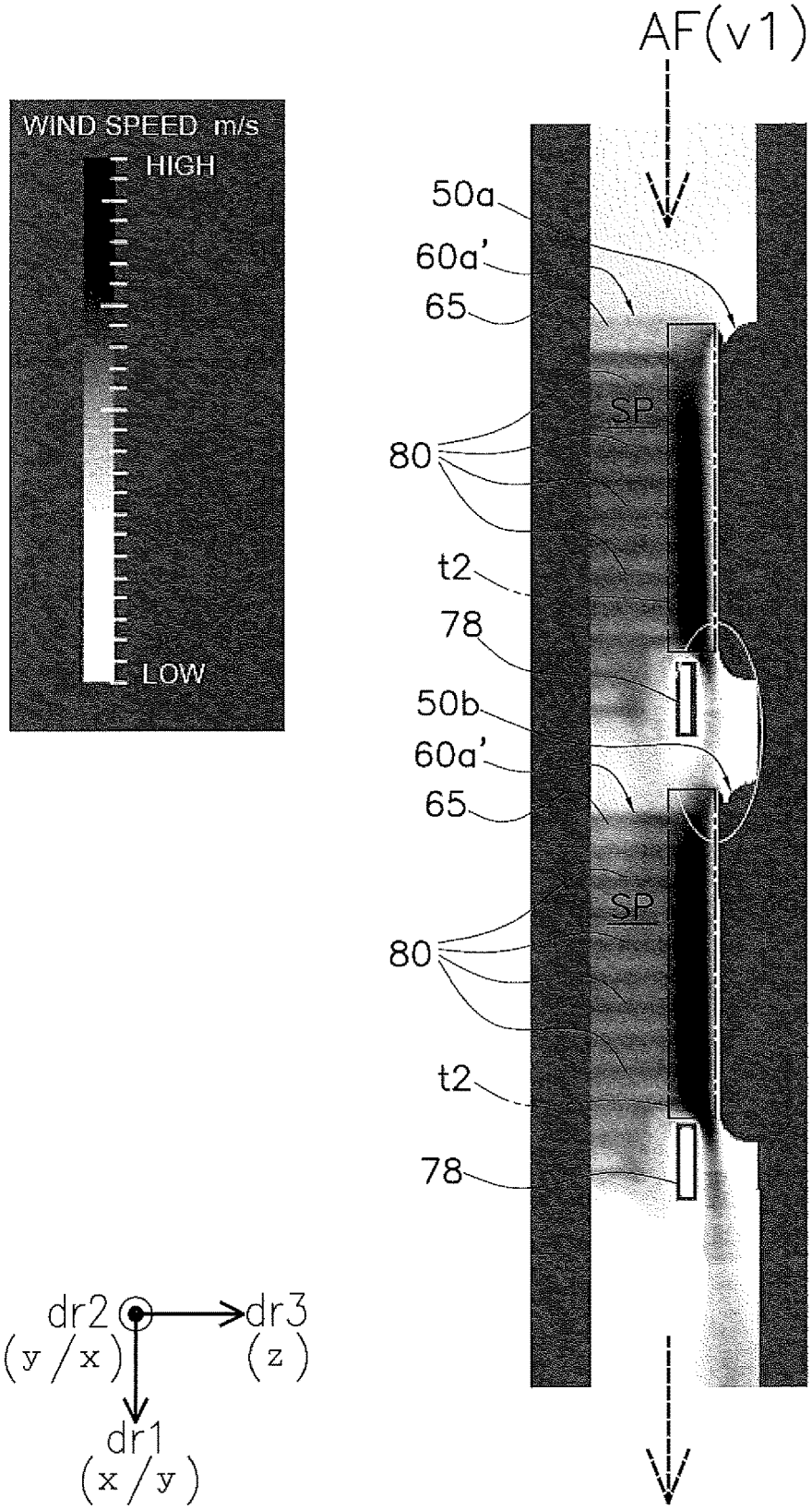
FIG. 19 is a schematic diagram illustrating a comparative example of a flow velocity distribution of an air flow, with respect to a heat transfer fin according to Modification I, in a case where a seventh protrusion is not provided (that is, when the ratio of the protruding area occupying in the reference area in the heat exchange space is less than 0.2).
Figure 20:
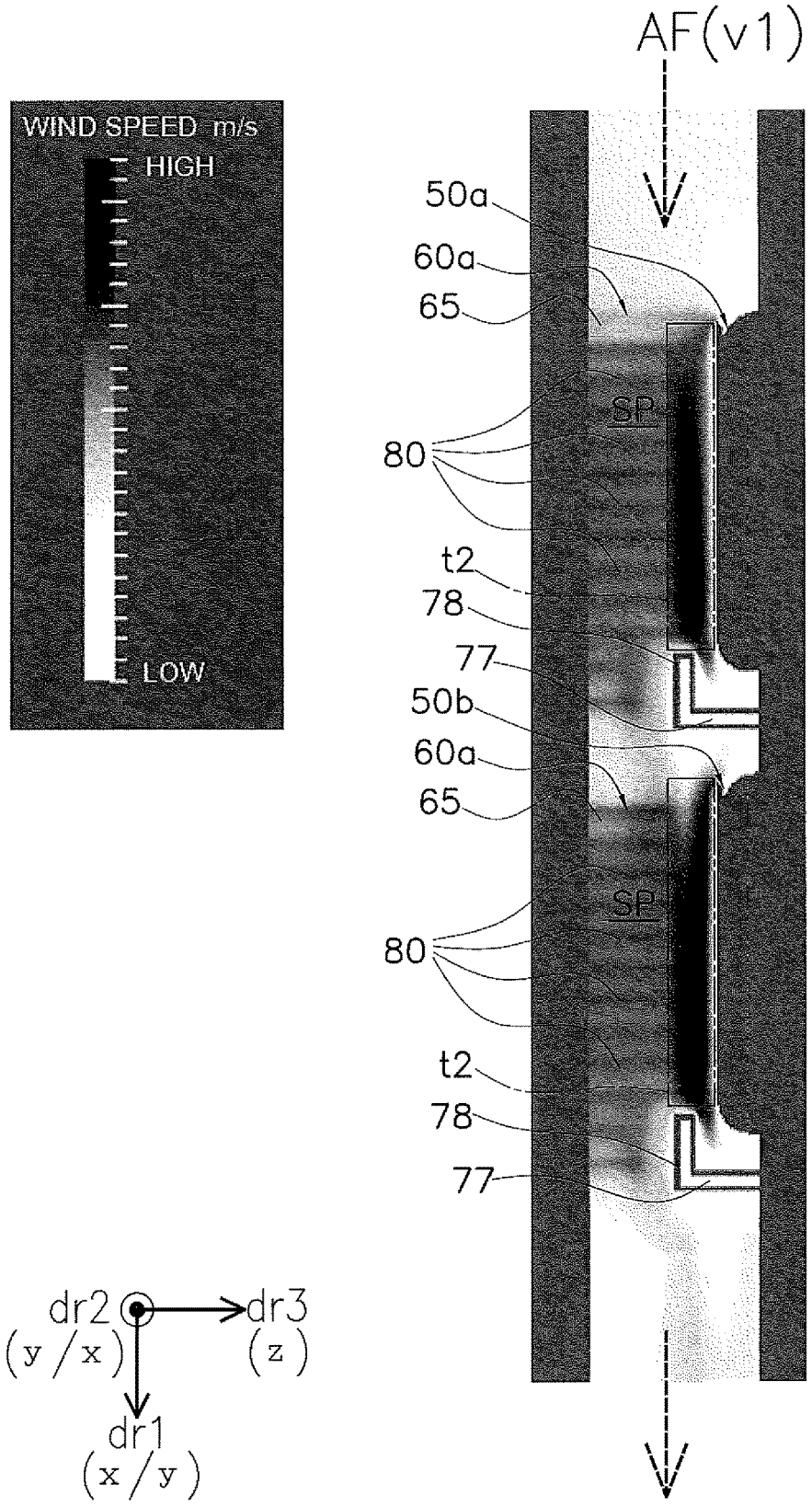
FIG. 20 is a schematic diagram illustrating an example of a flow velocity distribution of an air flow, with respect to a heat transfer fin according to Modification I, in a case where a seventh protrusion is provided (that is, when the ratio of the protruding area occupying in the reference area in the heat exchange space is equal to or greater than 0.2) according to one or more embodiments.

FIG. 19 is a schematic diagram showing an example of a flow velocity distribution of the air flow AF when the seventh protrusions 77 are not provided (that is, in the case where the ratio of the protruding area A1' occupying the reference area A2 in each of the heat exchange spaces SP is less than 0.2). FIG. 20 is a schematic diagram showing an example of the flow velocity distribution of the air flow AF when the seventh protrusions 77 are provided (that is, in the case where the ratio of the protruding area A1' occupying the reference area A2 in each of the heat exchange spaces SP is equal to or greater than 0.2 (more specifically, 0.5)). In FIG. 19 and FIG. 20, the black concentration (density) is shown more largely depending on the degree of the flow velocity of the air flow AF, indicating that the flow velocity of the air flow AF is higher.

As shown in FIG. 19, in the case where the seventh protrusions 77 are not provided, the proportion occupied by the portion, in which the flow velocity of the air flow AF is high, tends to increase in each of the exchange space SP located on the windward side and in each of the heat exchange space SP located on the leeward side. This is because when the ratio of the protruding area A1' occupying the reference area A2 in each of the heat exchange spaces SP is less than 0.2, the flow velocity of the air flow AF passing through such a gap (more specifically, the gap formed between each of the protrusions 70 and the main surfaces 52 of the heat transfer tubes 50) is particularly large (refer to the region indicated by dot-dashed lines t2 in FIG. 19), in relation to the fact that a large gap is formed between each of the protrusions 70 and the main surfaces 52 of the heat transfer tubes 50 (particularly, a large gap is formed at a position corresponding to the reference quadrilateral R1) in the state where each of the heat exchange spaces SP is viewed from the air flow direction dr1.

That is, when the ratio of the protruding area A1' occupying the reference area A2 in each of the heat exchange spaces SP is less than 0.2, in each of the heat exchange spaces SP, the drift phenomenon, in which the flow velocity of the air flow AF passing through one portion is considerably faster as compared with the flow velocity of the air flow AF passing through the other portions, easily occur. When such a drift phenomenon occurs, in the heat exchange spaces SP (particularly each of the heat exchange spaces SP on the leeward side), the amount of heat transferred in the portion between each of the protrusions 70 and the main surfaces 52 of the heat transfer tubes 50 is remarkably large as compared with that of the other portions. In other words, a portion having a large amount of heat transferred is formed to be partially biased in each of the heat exchange spaces SP. As a result, in each of the heat exchange spaces SP, the heat exchange between the air flow AF and the refrigerant in the heat transfer tubes 50 is not satisfactorily performed, and the performance of the heat exchanger 21 may decline.

On the other hand, as shown in FIG. 20, when the ratio of the protruding area A1' occupying the reference area A2 in each of the heat exchange spaces SP is equal to or greater than 0.2, the proportion occupied by the portion where the flow velocity of the air flow AF is high is restrained to increase in each of the heat exchange space SP located on the windward side and in each of the heat exchange space SP located on the leeward side. This is because when the ratio of the protruding area A1' occupying the reference area A2 in each of the heat exchange spaces SP is equal to or greater than 0.2, in relation to limiting the formation of a large gap between the seventh protrusions 77 and the main surfaces 52 of the heat transfer tubes 50 in a state where each of the heat exchange spaces SP is viewed from the air flow direction dr1, the flow velocity of the air flow AF passing through such a gap (more specifically, the gap formed between each of the protrusions 70 and the main surfaces 52 of the heat transfer tubes 50) is restrained from being increased (refer to the region t1 indicated by the dashed line in FIG. 20).

That is, when the ratio of the protruding area A1' occupying the reference area A2 in each of the heat exchange spaces SP is equal to or greater than 0.2, in each of the heat exchange spaces SP, the drift phenomenon, in which the portion where the flow velocity of the air flow AF is considerably high as compared with that of other portions is occur, is restrained. Therefore, as compared with the amounts of the other portions, the amount of heat transferred in the portion between each of the protrusions 70 and the main surfaces 52 of the heat transfer tubes 50 is prevented from getting significantly large.

In other words, in the entire respective heat exchange space SP, the biased formation of a region having a large amount of heat transferred and a region having a small amount of heat transferred, respectively, is restrained. As a result, a situation where the heat exchange is not performed satisfactorily between the air flow AF and the refrigerant in the heat transfer tubes 50 is restrained.

In addition, when the ratio of the protruding area A1' occupying the reference area A2 in each of the heat exchange spaces SP is equal to or greater than 0.2, the amount of heat transferred at the seventh protrusions 77 (that is, the amount of heat transferred between the most leeward side protrusion 70 and the air flow) increases in relation to the decrease in the formation of the large gap between the seventh protrusions 77 and the main surfaces 52 of the heat transfer tubes 50 (in particular, the decrease in the formation of the large gap at a position corresponding to the reference quadrilateral R1) in a state where each of the heat exchange spaces SP is viewed from the air flow direction dr1. As a result, the heat exchange between the air flow AF and the refrigerant in the heat transfer tubes 50 is promoted.

Similar to the above embodiments, when the ratio of the protruding area A1' occupying the reference area A2 in each of the heat exchange spaces SP is equal to or greater than 0.2, the performance degradation of the heat exchanger 21 is restrained.

Note that the shape, size, formation mode, and arrangement position of the eighth protrusions 78 for strength enhancement can be appropriately changed according to design specifications and environment.

Specifically, the eighth protrusions 78 may be configured so as to be out of the fin main body 63. For example, a part or entire of the eighth protrusions 78 may be disposed in the heat transfer promoting portion 65. In addition, a configuration may be adopted in which a part or entire of the eighth protrusions 78 is disposed such that the tip ends 781 thereof are located further to the windward side of the heat transfer fin 60*a* than the slits 62 (the end portions 501 of the heat transfer tubes 50) when viewed from the heat transfer fin extending direction dr3.

In addition, the eighth protrusions 78 are not necessarily disposed further to the windward side than the seventh protrusions 77 (the other-side-protrusions), but a part or entire of the eighth protrusions 78 may be respectively disposed further to the leeward side than the seventh protrusions 77.

According to the viewpoint that the eighth protrusions 78 coexist with the seventh protrusions 77 and the one-end-side-protrusions 80 in the narrow respective heat exchange space SP, in one or more embodiments the eighth protrusions 78, as being disposed in the heat transfer fin 60*a*, are disposed in the space formed between the one-end-side-protrusions 80 and the seventh protrusions 77 (the other-side-protrusions). However, as long as each of the protrusions 70 can be disposed in each of the heat exchange spaces SP, the eighth protrusions 78 do not necessarily have to be disposed in the space formed between the one-end-side-protrusions 80 and the seventh protrusions 77 (the other-side-protrusions) but may be disposed at another position.

According to the viewpoint that the eighth protrusions 78 and the seventh protrusions 77 (the other-side-protrusions) coexist in the narrow respective heat exchange space SP, in one or more embodiments the eighth protrusions 78 and the seventh protrusions 77, as being disposed in the heat transfer fin 60*a*, are integrally formed. However, as long as the eighth protrusions 78 and the seventh protrusions 77 can be disposed in each of the heat exchange spaces SP, the eighth protrusions 78 and the seventh protrusions 77 do not need to be formed integrally but may be configured separately. That is, the eighth protrusions 78 and the seventh protrusions 77 may be separated from each other.

Also, when the air flow AF flows in reverse to the direction shown in FIG. 16 (that is, when the air flow AF flows in the same manner as in FIGS. 12 and 13), the eighth protrusions 78 are disposed further to the windward side than the one-end-side-protrusions 80 and a majority of the eighth protrusions 78 is disposed further to the leeward side than the seventh protrusions 77. Further, in this case, the length d1 is, when viewed from the heat transfer fin extending direction dr3, the length of the portion of the respective eighth protrusions 78 that extends further to the leeward side (one end side of the heat transfer fin 60*a*) than the slits 62 (the end portions 501 of the heat transfer tubes 50).

Furthermore, the sixth protrusion 76 may be appropriately omitted.

Figure 21:
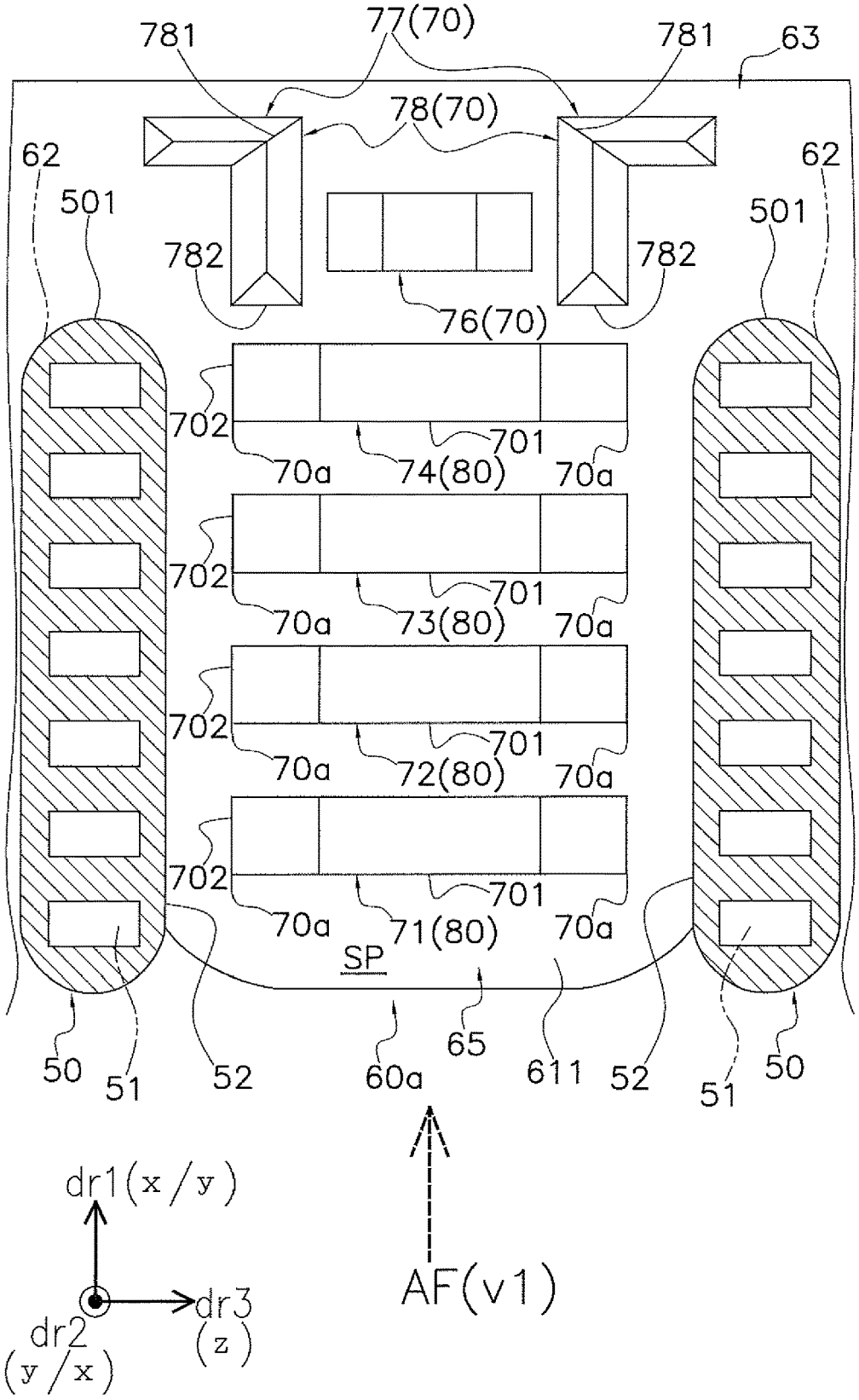
FIG. 21 is a schematic view of the heat exchange space constituted by another example of heat transfer fins according to Modification I as viewed from the heat transfer tube extending direction according to one or more embodiments.

Further, according to the viewpoint of further promoting the enhancement of the buckling strength of the heat transfer fin 60*a*, in one or more embodiments the eighth protrusions 78 be provided in a way a large length d1 is ensured. However, as shown in FIG. 18, even if the length d1 is zero or less, the effect of enhancing the buckling strength of the heat transfer fin 60*a* is achieved to some extent, and therefore the eighth protrusions 78 are not necessarily required to be provided in a manner that a portions thereof overlap with the slits 62 or the heat transfer tubes 50 when viewed from the heat transfer fin extending direction dr3. That is, as shown in FIG. 21, a configuration may be adopted in which the provision of the eighth protrusions 78 does not ensure the length d1 (that is, so that a portion of the respective eighth protrusions 78 does not overlap with the slits 62 or the heat transfer tubes 50 when viewed from the heat transfer fin extending direction dr3).

(4-10) Modification J

In one or more embodiments, the case where the heat exchanger 21 includes multiple (four) heat exchange units 40 has been described. However, the number of the heat exchange units 40 included in the heat exchanger 21 is not particularly limited thereto, and may be appropriately changed according to design specifications, and may be singular or a plurality of less than four or may be five or more.

(4-11) Modification K

In one or more embodiments, the heat exchanger 21 is configured so that the air flow direction dr1 corresponds to the "x" direction (left-right direction) or the "y" direction (front-back direction direction), the heat transfer tube extending direction dr2 corresponds to the "y" direction or "x" direction, and the heat transfer fin extending direction dr3 corresponds to the "z" direction (up-down direction). However, the correspondence relationship in each direction may be appropriately changed according to design specifications.

For example, the heat exchanger 21 may be configured so that the air flow direction dr1 or the heat transfer tube extending direction dr2 corresponds to the "z" direction (up-down direction). In addition, the heat exchanger 21 may be configured so that the heat transfer fin extending direction dr3 corresponds to the "x" direction or the "y" direction.

(4-12) Modification L

In one or more embodiments, the heat exchange unit 40 includes the windward side heat transfer tube 50*a* and the leeward side heat transfer tube 50*b*. That is, the heat exchange unit 40 has been arranged to include a plurality of stages configured by two rows of heat transfer tubes 50. However, the arrangement of the heat transfer tubes 50 included in the heat exchange unit 40 can be appropriately changed.

For example, in the heat exchange unit 40, the heat transfer tube 50 may be arranged so as to have only one of the windward side heat transfer tube 50*a* and the leeward side heat transfer tube 50*b*. That is, in the heat exchange unit 40, a single row of the heat transfer tubes 50 may be arranged in a plurality stages.

Further, for example, in the heat exchange unit 40, apart from the windward side heat transfer tube 50*a* and the leeward side heat transfer tube 50*b*, the heat transfer tubes 50 may be disposed so as to have a further heat transfer tube 50. That is, the heat exchanger 21 may be configured such that three or more rows of heat transfer tubes 50 are arranged in a plurality of stages in the heat exchange unit 40.

(4-13) Modification M

In one or more embodiments, each of the heat transfer tubes 50 is a flat multi-hole tube in which a plurality of refrigerant channels 51 is formed therein. However, the configuration of the heat transfer tube 50 can be appropriately changed. For example, a flat tube having a single refrigerant channel formed therein may be adopted as the heat transfer tube 50.

(4-14) Modification N

One or more embodiments of the present invention may be applied to an outdoor heat exchanger disposed in an outdoor unit or an indoor heat exchanger disposed in an indoor unit of an air conditioner. In this case, the air flow generated by the outdoor fan disposed in the outdoor unit or the indoor fan disposed in the indoor unit corresponds to the air flow AF in the above embodiments. Further, one or more embodiments of the present invention may be applied as a heat exchanger of a refrigeration apparatus other than an air conditioner (for example, a water heater including a refrigerant circuit and a blower, an ice making machine, a cold water machine, a dehumidifier, or the like).

INDUSTRIAL APPLICABILITY

One or more embodiments of the present invention are applicable to heat exchangers.

Although the disclosure has been described with respect to a limited number of embodiments, those skilled in the art, having benefit of this disclosure, will appreciate that various other embodiments may be devised without departing from the scope of the present invention. Accordingly, the scope of the present invention should be limited only by the attached claims.

REFERENCE SIGNS LIST

21 Heat exchanger
40 Heat exchange unit
50 Heat transfer tube
50*a* Windward side heat transfer tube
50*b* Leeward side heat transfer tube
51 Refrigerant channel
52 Main surface
60, 60*a* Heat transfer fin
62 Slit (Flat tube insertion hole)
63 Fin main body
65 Heat transfer promoting portion
70 Protrusion
70*a* Edge (One-side-protrusion's edge)

71 First protrusion
72 Second protrusion
73 Third protrusion
74 Fourth protrusion
75 Fifth protrusion (Leeward side protrusion/Windward side protrusion, Other-side-protrusion)
75*a* Edge
75*b* Edge
76 Sixth protrusion
77 Seventh protrusion (Leeward side protrusion/Windward side protrusion, Other-side-protrusion)
78 Eighth protrusion (Strength enhancement protrusion)
80 One-end-side-protrusion (Leeward side protrusion/Windward side protrusion, One-side-protrusion)
501 End portion (Leeward side end portion of flat tube)
521 Heat transfer tube front side surface
522 Heat transfer tube back side surface
611 Fin front side surface (Heat transfer fin front side surface)
612 Fin back side surface (Heat transfer fin back side surface)
701 Long side
702 Short side
751 Upper side
752 Lower side
753 Inclined surface
781 Tip end of eighth protrusion
782 Terminal end of eighth protrusion
A1, A1' Protruding area
A2 Reference area
AF Air flow
D1 Distance
H1 Dimension (Length of which one-side-protrusion protruding)
H2, H3 Dimensions (Length of which other-side-protrusion protruding)
L1 First side (One of lateral side and longitudinal side)
L2 Second side (Other one of lateral side and longitudinal side)
P1 Fin pitch
R1 Reference quadrilateral (Quadrilateral)
SP Heat exchange space
dr1 Air flow direction (First direction)
dr2 Heat transfer tube extending direction (Second direction)
dr3 Heat transfer fin extending direction (Third direction)
v1 Air flow directional view

CITATION LIST

Patent Literature

Patent Document 1 (Japanese Patent No. 4845943)

The invention claimed is:

1. A heat exchanger comprising:

multiple flat tubes that extend in a second direction intersecting a first direction that is an air flow direction and that are disposed at intervals in a third direction that intersects the first direction and the second direction; and multiple heat transfer fins that extend along the third direction and that are disposed at intervals along the second direction, wherein the heat exchanger causes refrigerant in the flat tubes to exchange heat with the air flow that passes through heat exchange spaces formed by adjacent flat tubes and adjacent heat transfer fins when viewed from the first direction, the heat transfer fins each have a heat transfer fin front side surface that is one main surface, a heat transfer fin back side surface that is the other main surface, and a plurality of protrusions that are bulging portions or cut and raised portions that protrude along the second direction from the heat transfer fin front side surface or the heat transfer fin back side surface, the plurality of protrusions are disposed in the first direction in each of the heat exchange spaces, and the plurality of protrusions includes a leeward side protrusion located on the leeward side and a windward side protrusion located further to the windward side than the leeward side protrusion, each of the heat exchange spaces comprises:

a one-side-protrusion that is one of either the windward side protrusion or the leeward side protrusion and that protrudes from either the heat transfer fin front side surface or the heat transfer fin back side surface;

an other-side-protrusion that is the other of the windward side protrusion or the leeward side protrusion;

a reference area that, when viewed from an air flow directional view from the windward side to the leeward side of the first direction, is a quadrilateral with a lateral side and a longitudinal side where one of either the lateral side and the longitudinal side is defined by a length located between an edge of the one-side-protrusion, which is disposed in the heat transfer fin front side surface or the heat transfer fin back side surface that the one-side-protrusion protrudes from, and a main surface of the flat tube closest to the edge of the one-side-protrusion, and the other of the lateral side and the longitudinal side is defined by a fin pitch of the heat transfer fins; and a protruding area that is a subset of the reference area occupied by an inclined surface of the other-side-protrusion when viewed from the air flow directional view from the windward side to the leeward side of the first direction, and a ratio of the protruding area to the reference area is equal to or greater than 0.2, the plurality of protrusions include a strength enhancement protrusion that extends from one end side in the first direction towards the other end side in the first direction of the heat transfer fin and that increases strength of the heat transfer fin, the heat transfer fin is formed with a plurality of flat tube insertion holes into which the flat tubes are inserted, the flat tube insertion holes extend from one end side in the first direction towards the other end side in the first direction of the heat transfer fin, and when viewed from the third direction, a tip end of the strength enhancement protrusion is positioned further to the other end side in the first direction of the heat transfer fin than an edge, which is closest to the other end side in the first direction of the heat transfer fin, of the flat tube insertion hole.

2. The heat exchanger according to claim 1, wherein when the heat exchange space is viewed from the third direction, the other-side-protrusion is disposed at a position where a distance is greater than zero, the distance is provided between one of either a windward side edge of the other-side-protrusion and a leeward side edge of the other-side-protrusion that is closer to the flat tube and one of either a windward side end portion of the flat tube and a leeward side end portion of the flat tube that is closer to the other-side-protrusion.

3. The heat exchanger according to claim 1, wherein according to the air flow directional view, a protruding length of the other-side-protrusion is equal to or longer than a protruding length of the one-side-protrusion.

4. The heat exchanger according to claim 1, wherein the other-side-protrusion is disposed at the most windward side or at the most leeward side of the plurality of protrusions.

5. The heat exchanger according to claim 1, wherein the ratio of the protruding area to the reference area is equal to or greater than 0.5.

6. The heat exchanger according to claim 1, wherein the heat transfer fin is formed with a plurality of flat tube insertion holes into which the flat tubes are inserted, the flat tube insertion holes extend from one end side in the first direction towards the other end side in the first direction of the heat transfer fin, and when viewed from the third direction, a terminal end of the strength enhancement protrusion is positioned further to one end side in the first direction of the heat transfer fin than the edge of the flat tube insertion hole.

7. The heat exchanger according to claim 1, wherein the heat transfer fin includes a fin main body that extends continuously from one end side in the third direction toward the other end side in the third direction of the heat transfer fin, and the strength enhancement protrusion is partially or entirely disposed on the fin main body.

8. The heat exchanger according to claim 1, wherein when viewed from the third direction, the strength enhancement protrusion is partially or entirely disposed between the one-side-protrusion and the other-side-protrusion.

9. The heat exchanger according to claim 1, wherein the strength enhancement protrusion is integrated with the other-side-protrusion.

* * * * *